US008636348B2

(12) United States Patent
Kondo et al.

(10) Patent No.: US 8,636,348 B2
(45) Date of Patent: Jan. 28, 2014

(54) INKJET PRINTER

(75) Inventors: Kazuyuki Kondo, Kuwana (JP); Naoki Mizuno, Obu (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 13/489,119

(22) Filed: Jun. 5, 2012

(65) Prior Publication Data

US 2012/0320132 A1 Dec. 20, 2012

(30) Foreign Application Priority Data

Jun. 17, 2011 (JP) ..... 2011-134698

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 2,090,178 | A * | 8/1937 | Brickner | 200/61.42 |
| 4,621,436 | A * | 11/1986 | Kurimoto | 33/561 |
| 4,679,332 | A * | 7/1987 | Luthi | 33/559 |
| 5,084,673 | A * | 1/1992 | Kazama | 324/755.05 |
| 5,801,736 | A * | 9/1998 | Ikkatai et al. | 347/86 |
| 5,864,533 | A * | 1/1999 | Yamada et al. | 720/693 |
| 5,886,603 | A * | 3/1999 | Powell | 335/164 |
| 6,653,583 | B1 * | 11/2003 | Asa | 200/249 |
| 6,666,784 | B1 * | 12/2003 | Iwamoto et al. | 474/109 |
| 7,116,123 | B2 * | 10/2006 | Goto | 324/755.05 |
| 7,271,356 | B2 * | 9/2007 | Truett | 200/47 |
| 7,319,827 | B2 * | 1/2008 | Yoshizawa | 399/12 |
| 7,556,033 | B2 * | 7/2009 | Kim | 126/197 |
| 8,434,859 | B2 * | 5/2013 | Karasawa et al. | 347/86 |
| 2003/0085970 | A1 * | 5/2003 | Sakai et al. | 347/86 |
| 2005/0145473 | A1 * | 7/2005 | Ni | 200/563 |
| 2005/0157104 | A1 | 7/2005 | Hirota et al. | |
| 2008/0159772 | A1 * | 7/2008 | Koishi et al. | 399/90 |
| 2011/0061431 | A1 * | 3/2011 | Mizukawa | 72/31.1 |
| 2011/0187772 | A1 * | 8/2011 | Tomoguchi et al. | 347/7 |

FOREIGN PATENT DOCUMENTS

JP 2005-169839 A 6/2005

* cited by examiner

*Primary Examiner* — Matthew Luu
*Assistant Examiner* — Patrick King
(74) *Attorney, Agent, or Firm* — Fox Rothschild LLP

(57) ABSTRACT

An inkjet printer printing includes a cartridge mounting portion in which a ink cartridge can be inserted, and a detection portion including a detection switch having a leading end portion and detecting whether the ink cartridge is inserted in the cartridge mounting portion in accordance with a displacement amount of the leading end portion, the leading end portion being penetratingly supported via a first elastic member so as to be displaceable such that the leading end portion protrudes to the outside, and a protruding portion provided on the leading end portion side of the detection switch via a second elastic member so as to be displaceable and protrudes toward the cartridge mounting portion, the second elastic member having an elastic modulus that is smaller than an elastic modulus of the first elastic member and causing the first elastic member to be deformed when the second elastic member is deformed.

8 Claims, 23 Drawing Sheets

INKJET PRINTER

CROSS-REFERENCE TO RELATED APPLICATION

This Application claims priority from JP2011-134698, filed on Jun. 17, 2011, the content of which is hereby incorporated by reference.

BACKGROUND

The present disclosure relates to an inkjet printer that performs printing using ink supplied from an ink cartridge.

Generally, an inkjet printer requires an ink cartridge to supply ink to a print head. Therefore, the inkjet printer is formed such that the ink cartridge can be inserted into and removed from a predetermined mounting position, and the inkjet printer is provided with a detection portion that detects whether the ink cartridge is inserted. Various types of known sensors are used as the detection portion, and a limit switch can be used, for example.

SUMMARY

The limit switch operates an actuator by movement of an operation body and transmits movement of the actuator to a sealed switch, thereby opening and closing an electrical circuit. Generally, a stroke (an amount of displacement) that can be detected by the limit switch is small. If the stroke is too small when detecting whether the ink cartridge is inserted, there is a case in which it is not possible to accurately detect whether the ink cartridge is inserted due to a machining error of a member to which the limit switch is attached or of a housing of the ink cartridge.

The present disclosure provides an inkjet printer that is capable of reliably detecting whether an ink cartridge is inserted.

According to an aspect of the present disclosure, there is provided an inkjet printer that performs printing using ink supplied from an ink cartridge, the inkjet printer includes a cartridge mounting portion and a detection portion. The ink cartridge can be inserted into and removed from the cartridge mounting portion. The detection portion is arranged in the cartridge mounting portion and includes a detection switch and a protruding portion. The detection switch has a housing and a leading end portion. The detection switch detects whether the ink cartridge is inserted in the cartridge mounting portion in accordance with a displacement amount of the leading end portion when the leading end portion is pressed, the leading end portion being penetratingly supported by the housing via a first elastic member so as to be slidingly displaceable such that the leading end portion protrudes to the outside from the housing. The protruding portion is provided on the leading end portion side of the detection switch via a second elastic member so as to be displaceable. The protruding portion protrudes toward the cartridge mounting portion, the second elastic member having an elastic modulus that is smaller than an elastic modulus of the first elastic member and causing the first elastic member to be deformed when the second elastic member is deformed by at least a predetermined amount.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Figure 1:
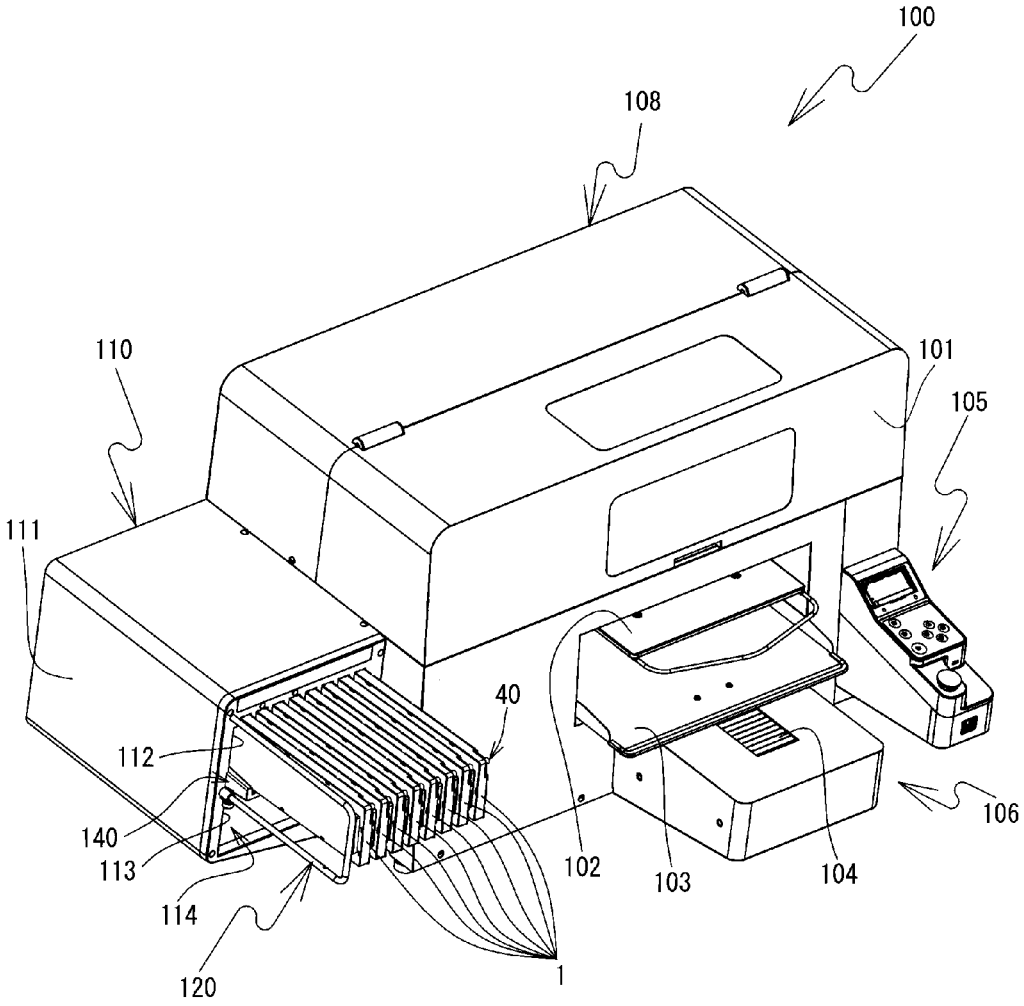
FIG. 1 is a perspective view showing an external appearance of an inkjet printer 100.

Hereinafter, an embodiment of the present disclosure will be explained with reference to the appended drawings. In the present embodiment, an inkjet printer (hereinafter simply referred to as a printer) 100 that performs printing on a fabric such as a t-shirt using an ink cartridge (hereinafter simply referred to as a cartridge) 1 will be explained.

A schematic structure of the printer 100 will be explained with reference to FIG. 1. The printer 100 is a printer that can perform printing on a fabric, which is a printing medium, by a print head (not shown in the drawings) using ink supplied from the cartridge 1. An up-down direction, a lower right direction, an upper left direction, a lower left direction and an upper right direction in FIG. 1 respectively correspond to an up-down direction, a front direction, a rear (back) direction, a left direction and a right direction of the printer 100 and the cartridge 1.

As shown in FIG. 1, the printer 100 includes a body portion 108 having a substantially rectangular parallelepiped shape and a cartridge mounting unit 110 having a substantially rectangular parallelepiped shape that is smaller than the body portion 108. The body portion 108 is a portion that mainly performs printing using a print head while moving a fabric, and has a similar structure to that of a known inkjet printer for fabric printing. The cartridge mounting unit 110 is a portion in which the cartridge 1 that supplies ink is inserted. The cartridge mounting unit 110 is detachably attached to a lower left portion of the body portion 108.

The body portion 108 is provided with a housing 101. A platen drive mechanism 106 is provided in a central portion in the left-right direction of the body portion 108. The platen drive mechanism 106 includes a platen 102, a tray 103, a drive belt 104, a pair of guide rails (not shown in the drawings), a platen drive motor (not shown in the drawings) and the like.

The drive belt 104 is stretched between pulleys (not shown in the drawings) that are respectively arranged at front and rear sides of the body portion 108. The platen 102 and the tray 103, each having a rectangular plate shape, are supported by a support pillar (not shown in the drawings) that is fixed above the drive belt 104. A fabric, such as a t-shirt, is placed on an upper surface of the platen 102. The tray 103 is disposed below and substantially parallel to the platen 102. The tray 103 is a plate-like body that is one size larger than the platen 102. The tray 103 inhibits a sleeve etc. of the t-shirt placed on the platen 102 from falling down. The pair of guide rails extend in the front-rear direction above the drive belt 104 and guide the platen 102 and the tray 103. The platen drive motor drives the drive belt 104 via the above-described pulleys. When the platen drive motor drives the drive belt 104, the platen 102 and the tray 103 move in the front-rear direction along the guide rails, via the support pillar. An opening is provided in a central portion of a front surface of the housing 101, and the platen 102 and the tray 103 enter and leave the housing 101 via the opening.

A pair of guide rails (not shown in the drawings) are disposed inside the housing 101 of the body portion 108, in a substantially central position in the front-rear direction and above the platen 102. The guide rails extend in the left-right direction and support a carriage. Print heads are fixed below the carriage. The number of the print heads differs depending on a type of the inkjet printer. In the present embodiment, the number of the print heads of the printer 100 is eight. The carriage is moved in the left-right direction along the guide rails by a carriage drive mechanism that includes a carriage drive motor and a belt transmission mechanism. The eight print heads are respectively supplied, via a tube 182 (refer to FIG. 7), with ink from the eight cartridges 1 that are inserted in the cartridge mounting unit 110. A plurality of fine nozzles are provided on a bottom surface of each of the print heads, and droplets of the ink are ejected downward from the nozzles by driving a piezoelectric element. Thus, printing is performed on the fabric placed on the platen 102. An operation portion 105 is provided on a lower right portion of a front surface of the body portion 108. The operation portion 105 is provided with a display that displays various types of information, and buttons etc. that are used to input commands corresponding to various operations of the printer 100.

A total of the eight cartridges 1 can be inserted in the cartridge mounting unit 110. Normally, the four ink cartridges 1 for storing white ink, and the four ink cartridges 1 for respectively storing four colors of ink, i.e., cyan, magenta, yellow and black ink, are used as the eight cartridges 1. The cartridges 1 are inserted into and removed from a holder unit 150 (refer to FIG. 5) in the cartridge mounting unit 110, via an opening 112 that is provided in an upper portion of the front surface of the housing 111.

The cartridge mounting unit 110 is provided with the housing 111. Although not shown in the drawings, the right side of the housing 111 is open, and a fixing portion is provided to detachably fix the cartridge mounting unit 110 to the body portion 108. The cartridge mounting unit 110 is fixed to a receiving portion (not shown in the drawings) of the body portion 108 using a screw via the fixing portion, for example. The use of the cartridge mounting unit 110 is not limited to the printer 100. The cartridge mounting unit 110 is formed as a general-purpose unit that can also be attached to and removed from another type of inkjet printer having print heads whose number is other than eight.

The opening 112 having a substantially rectangular shape that is long in the left-right direction is provided in the upper portion of the front surface of the housing 111. The holder unit 150 (refer to FIG. 5) in which the eight cartridges 1 can be inserted is arranged to the rear of the opening 112, namely, inside the housing 111. Each of the cartridges 1 is inserted into and removed from the holder unit 150 (more specifically, a holder 159) arranged inside the housing 111, via the opening 112. A connection portion 180 (refer to FIG. 7) that includes a lead-out needle 183 to draw out the ink is provided to the rear of the holder unit 150. A protective member 120 that protrudes forward from the front surface of the housing 111 is attached to the left side of the opening 112. The protective member 120 is a member to inhibit the cartridge 1 and the lead-out needle 183 from being damaged by an operator colliding with the cartridge 1 inserted in the cartridge mounting unit 110.

Further, the housing 111 is provided with a guide portion 140 that protrudes forward from the front surface of the housing 111 along a lower edge portion of the opening 112. The guide portion 140 is a portion that guides the cartridge 1 so that the cartridge 1 is smoothly inserted into an appropriate one of the holders 159 (refer to FIG. 5) via the opening 112. The operator places the cartridge 1 on a position of the guide portion 140 corresponding to a desired one of the holders 159 and pushes the cartridge 1, in a state in which a rear wall 33 (refer to FIG. 2) is on the rear side and a bottom wall 31 (refer to FIG. 2) is on the lower side. The cartridge 1 is guided by the guide portion 140 and is smoothly inserted into the holder 159.

An accommodation portion 114 is provided below the guide portion 140. The accommodation portion 114 is a recessed portion that extends from an opening 113 to the inside of the housing 111. The cartridges 1 that are not used and other goods relating to the printer 100 are accommodated in the accommodation portion 114. A back surface of the housing 111 is formed as a door portion 115 (refer to FIG. 8) that can be opened and closed via a hinge. An internal structure of the cartridge mounting unit 110 will be described in more detail later.

A structure of the cartridge 1 that is inserted in the cartridge mounting unit 110 and is used in the printer 100 will be explained with reference to FIG. 2 to FIG. 4. The cartridge 1 is provided with a thin plastic case 2 having a substantially box shape that is long in the front-rear direction, and an ink pack 7 (refer to FIG. 4) that is accommodated in the case 2. Hereinafter, structures of the case 2 and the ink pack 7 will be explained in order. Note that the cartridges 1 of the five colors have the same structure, except that the colors of the liquid ink stored in the ink packs 7 are different from each other.

First, the case 2 will be explained with reference to FIG. 2 and FIG. 3. As shown in FIG. 2 and FIG. 3, as a whole, the case 2 has a rectangular parallelepiped shape that is long in the front-rear direction and thin in the left-right direction, and a corner at the lower rear end of the case 2 is diagonally cut out. The case 2 includes a main body portion 3 and a lid portion 4. The main body portion 3 includes a left wall 30, the bottom wall 31, a top wall 32, the rear wall 33 and a front wall 34 that each have a thin plate shape and that respectively form a left side surface, a bottom surface, a top surface, a back surface and a front surface of the case 2. The rear wall 33 includes a back surface portion 331 that is connected to the top wall 32 such that they form a right angle, and an inclined surface portion 332 that diagonally connects the bottom wall 31 and the back surface portion 331. The lid portion 4 faces the left wall 30 and forms a right side surface of the case 2. The lid portion 4 is a thin plate member and has a substantially pentagonal shape corresponding to the left wall 30 of the main body portion 3. The case 2 is formed by joining the lid portion 4 to the main body portion 3 such that the left wall 30 and the lid portion 4 face each other.

Five leg portions 301 to 305 that protrude from an outer surface (the left side surface of the case 2) are provided on the left wall 30 of the case 2. Specifically, on a rear end portion of the left wall 30, the leg portion 301 and the leg portion 302 are provided respectively in a section that is connected to the inclined surface portion 332 and in a section that is connected to the back surface portion 331. The leg portion 303 and the leg portion 304 are respectively provided in positions that are separated from the leg portion 301 and the leg portion 302 toward the front (in the upper right direction in FIG. 2). The leg portion 305 is provided in the vicinity of a front end portion of the left wall 30. Note that all the leg portions 301 to 305 are provided in positions where they do not interfere with an upper rail portion 161 and a lower rail portion 171 of the holder 159 when the cartridge 1 is inserted in the holder 159 (refer to FIG. 6), which will be described later. When the cartridge 1 is placed on a flat surface in a state in which the left wall 30 is on the lower side, the leg portions 301 to 305 have a function of stably supporting the cartridge 1 in a state in which the entire left wall 30 is separated from the flat surface.

Figure 2:
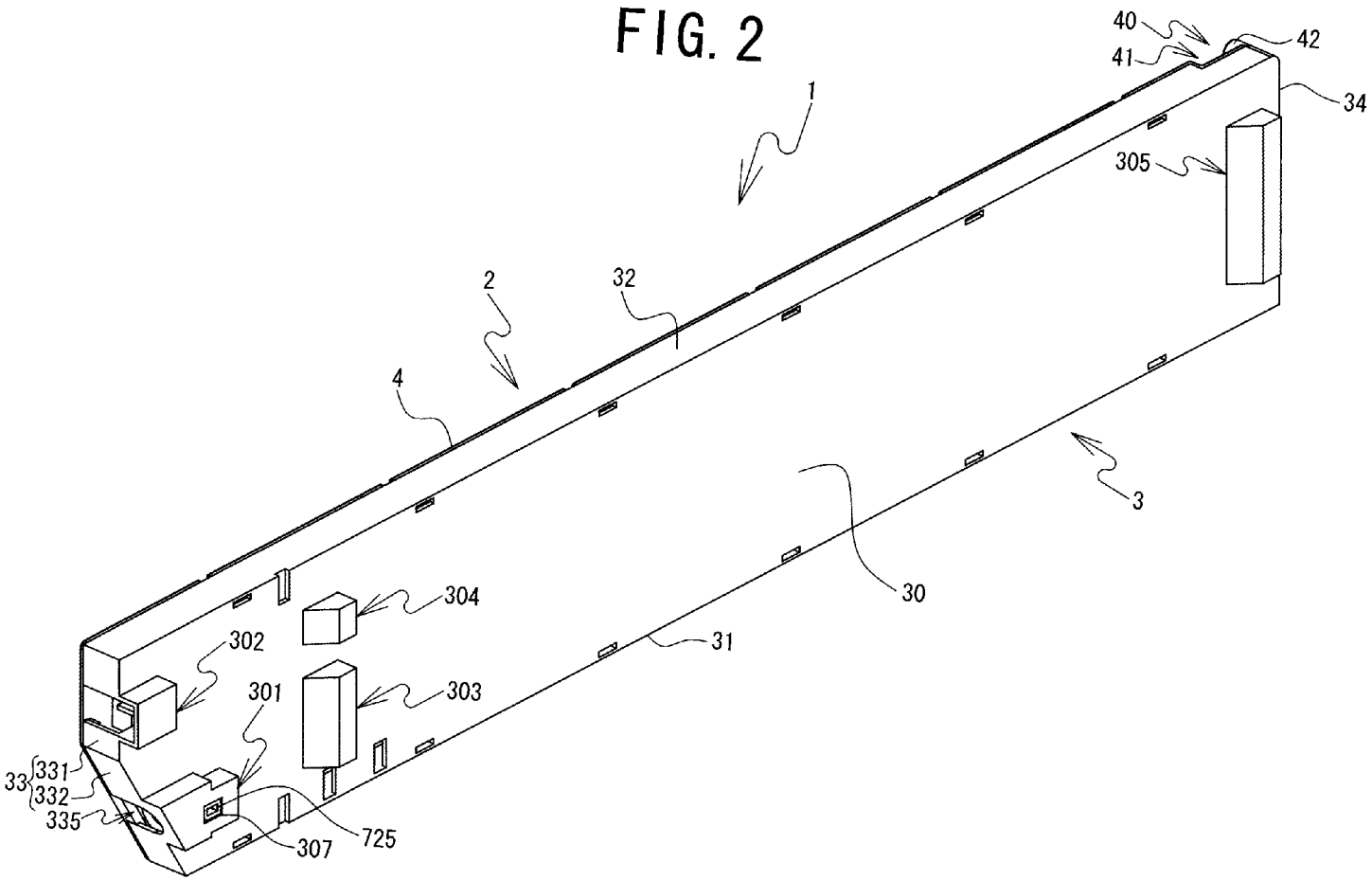
FIG. 2 is a perspective view of an ink cartridge 1 as viewed from the rear left.

As shown in FIG. 2, an opening 335 is provided in the inclined surface portion 332 of the rear wall 33 of the case 2, in a position corresponding to the leg portion 301. The opening 335 is an opening portion to draw out the ink from the ink pack 7 (refer to FIG. 4) accommodated in the case 2, and the ink pack 7 is arranged in the case 2 such that a plug 72 (refer to FIG. 4) faces the opening 335. The leg portion 301 that is adjacent to the opening 335 also functions as a wall portion that forms a space for accommodating the plug 72. A rectangular shaped engagement hole 307 is provided in the leg portion 301, in the vicinity of a central portion of a flat surface portion of the protruding end. The engagement hole 307 is an opening portion that is used to determine the position of the plug 72 of the ink pack 7 with respect to the main body portion 3 and to fix the plug 72.

Figure 3:
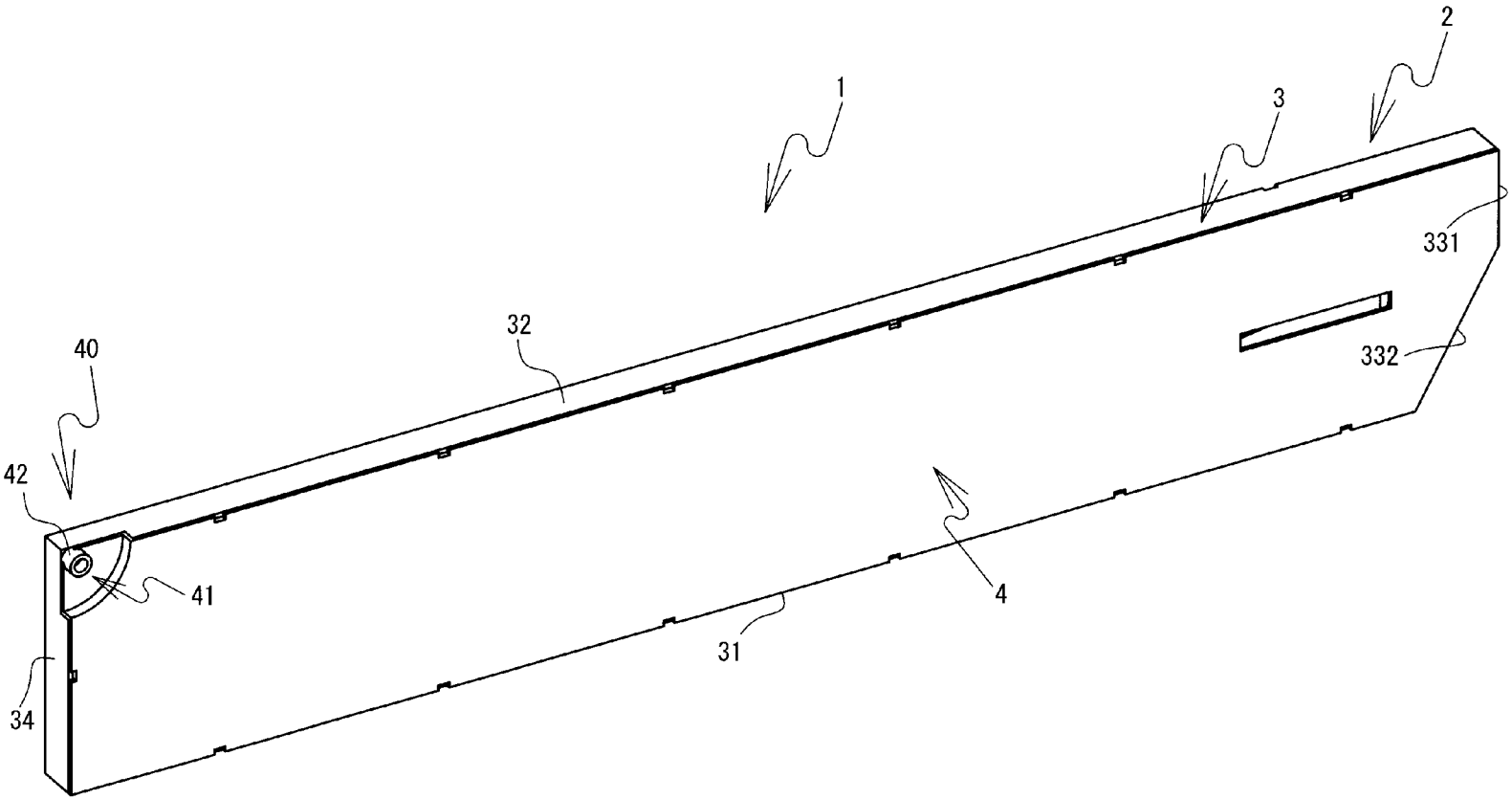
FIG. 3 is a perspective view of the ink cartridge 1 as viewed from the front right.
Figure 4:
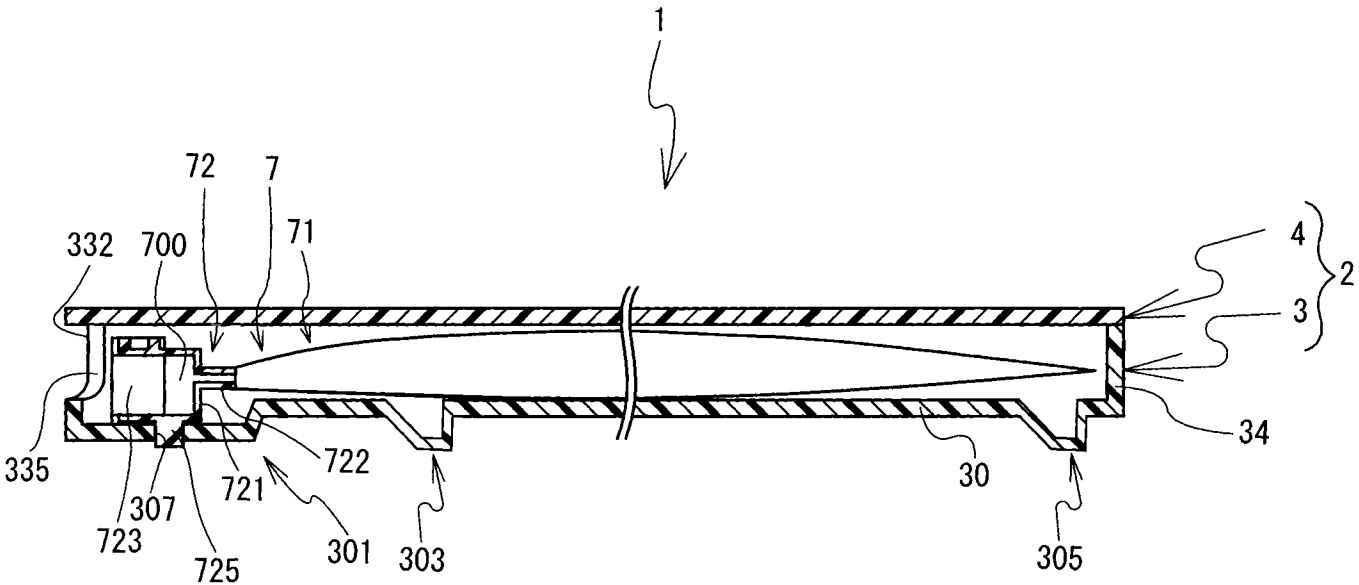
FIG. 4 is a cross-sectional view illustrating an internal structure of the ink cartridge 1.

As shown in FIG. 2 and FIG. 3, a handle portion 40 is provided on an upper right corner portion (an upper left corner portion of the lid portion 4 in FIG. 3) of a front end portion of the case 2. The handle portion 40 includes a recessed portion 41 that is recessed inwardly from the outer surface of the case 2, and a protruding portion 42 that protrudes from the recessed portion 41. The handle portion 40 is used when the operator takes out a given one of the cartridges 1 in a state in which the cartridges 1 are inserted in the cartridge mounting unit 110 with a slight gap therebetween, as shown in FIG. 1.

The ink pack 7 will be explained with reference to FIG. 4. As shown in FIG. 4, the ink pack 7 includes an ink bag 71 that stores ink and the plug 72 that is provided on the ink bag 71. The ink bag 71 is a bag-shaped container. For example, the ink bag 71 is formed such that two rectangular-shaped flexible plastic sheets are overlapped with each other in a state in which inner surfaces of the sheets face each other, and a surrounding portion along four sides is thermally welded (heat sealed).

The plug 72 is provided with a substantially cylindrically shaped body portion 721, and two blade-like coupling portions 722 that protrude in directions opposite to each other from an outer peripheral surface of the body portion 721, on one end of the body portion 721. Although the body portion 721 has a substantially cylindrical shape, an outer shape of a leading end portion that is on a side opposite to the end on which the coupling portions 722 of the body portion 721 are provided is formed in a rectangular block shape. The plug 72 is fixed to the ink bag 71 such that the one end portion of the body portion 721 including the coupling portions 722 is inserted between the two sheets that form the ink bag 71 and is integrally welded with the surrounding portion of the ink bag 71. Other portions of the body portion 721 that are not welded with the surrounding portion protrude to the outside of the ink bag 71 from one end portion in the longitudinal direction of the ink bag 71.

A cylindrically-shaped hollow portion 700 is provided inside the body portion 721. A column shaped rubber plug 723 is inserted in an end portion of the hollow portion 700 of the body portion 721, the end portion being on an opposite side to the ink bag 71. In other words, an opening on the leading end side of the plug 72 is blocked by the rubber plug 723. In this manner, the ink is stored in the ink bag 71 in a sealed state. Further, a square column shaped engagement protrusion 725 that protrudes outward in the circumferential direction is provided in a section of the body portion 721 that is formed in a rectangular block shape. The position of the ink pack 7 is determined with respect to the main body portion 3 of the case 2 by the engagement protrusion 725 being engaged with the above-described engagement hole 307 of the leg portion 301, and thus the ink pack 7 is fixed.

Hereinafter, an internal structure of the housing 111 of the cartridge mounting unit 110 will be explained with reference to FIG. 5 to FIG. 10. The holder unit 150 (refer to FIG. 5) in which the cartridge 1 is inserted, the connection portion 180 (refer to FIG. 7) to draw out the ink from the cartridge 1, and a detection unit 130 (refer to FIG. 9) are arranged inside the housing 111. Structures of these components will be explained below in order.

Figure 5:
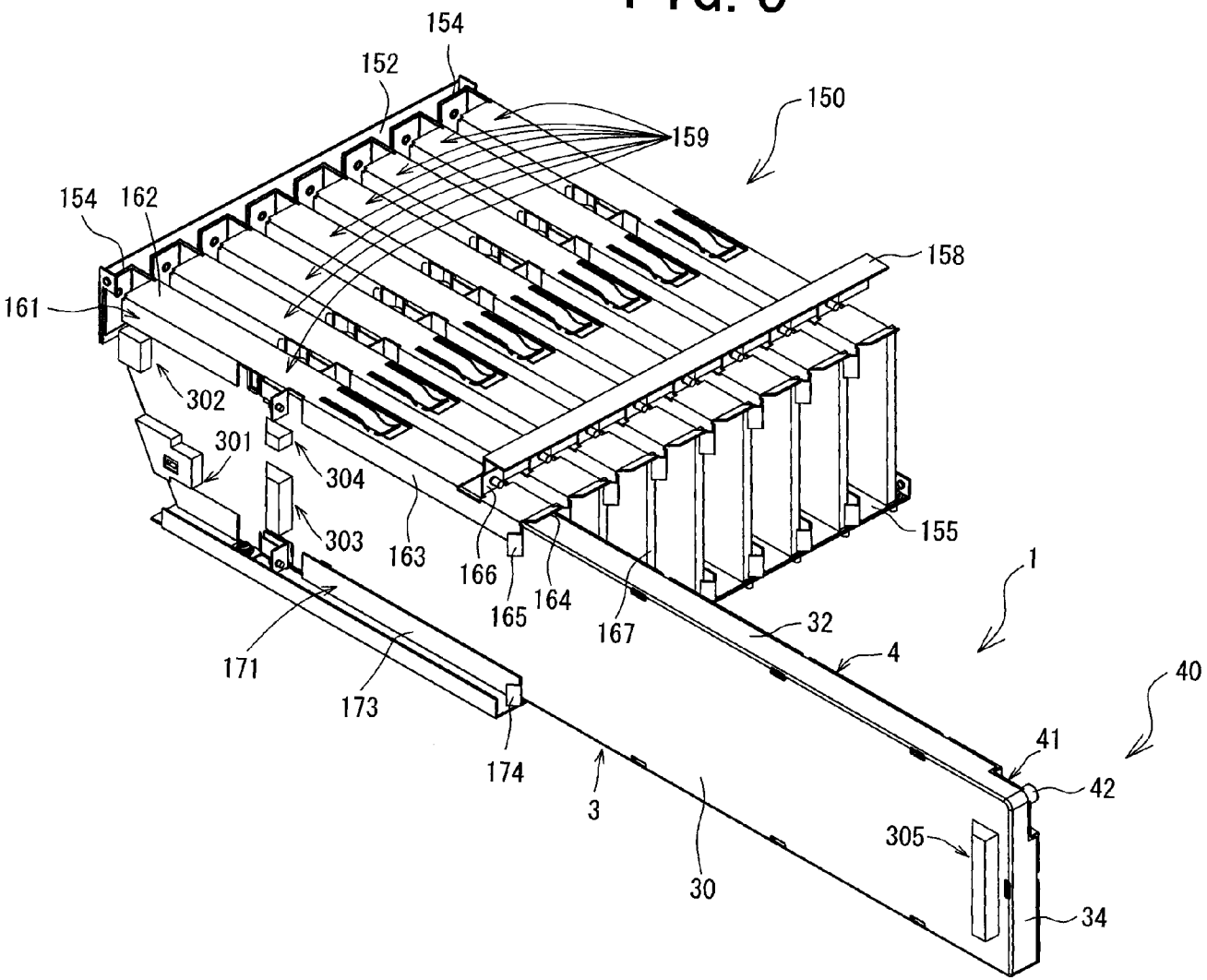
FIG. 5 is a perspective view of a holder unit 150.

First, the structure of the holder unit 150 will be explained with reference to FIG. 5, FIG. 6 and FIG. 9. Note that FIG. 5 shows an example in which one of the cartridges 1 is inserted into the holder unit 150, and in order to simplify the drawing, an illustration of the other portions (including the housing 101) of the cartridge mounting unit 110 is omitted. As shown in FIG. 5, the holder unit 150 is provided with the eight holders 159 that are arranged in equal intervals in the left-right direction, and a mounting plate 155, a fixing plate 152 and a fixing plate 158 to which the holders 159 are fixed. Note that the up-down direction, the lower right diagonal direction, the upper left direction, the lower left direction and the upper right direction of FIG. 5 respectively correspond to the up-down direction, the front direction, the rear (back) direction, the left direction and the right direction of the holder unit 150 and the holders 159.

The structure of the holder 159 will be explained in detail with reference to FIG. 6 and FIG. 9. The holder 159 is a member that holds the cartridge 1 and guides the cartridge 1 to an appropriate mounting position. The holder 159 is formed of a plate-shaped member made of metal and its shape substantially corresponds to the shape of the cartridge 1. As shown in FIG. 6, the holder 159 includes a right guide portion 160, the upper rail portion 161 and the lower rail portion 171.

The right guide portion 160 is a portion that guides a right end portion of the case 2 (more specifically, an outer surface of the lid portion 4 (refer to FIG. 3)) when the cartridge 1 is inserted into the holder 159. The right guide portion 160 is a substantially pentagonal shaped plate portion that substantially corresponds to the side view shape of a rear portion of the lid portion 4 of the cartridge 1. Note that, as shown in FIG. 6 and FIG. 9, an upper portion of a rear end portion of the right guide portion 160 protrudes to the rear. Further, a bent portion 154 that bends to the left is formed at the leading end of the upper portion of the rear end portion of the right guide portion 160. The bent portion 154 has a screw hole. A plate surface of the right guide portion 160 is arranged in the up-down direction of the cartridge mounting unit 110 (refer to FIG. 1). The length of the right guide portion 160 in the longitudinal direction is slightly shorter than half the length of the cartridge 1 in the front-rear direction. A right receiving portion 167 is connected to the front end of the right guide portion 160. The right receiving portion 167 is a portion that extends from the front end of the right guide portion 160 to the front and slightly to the right.

Figure 6:
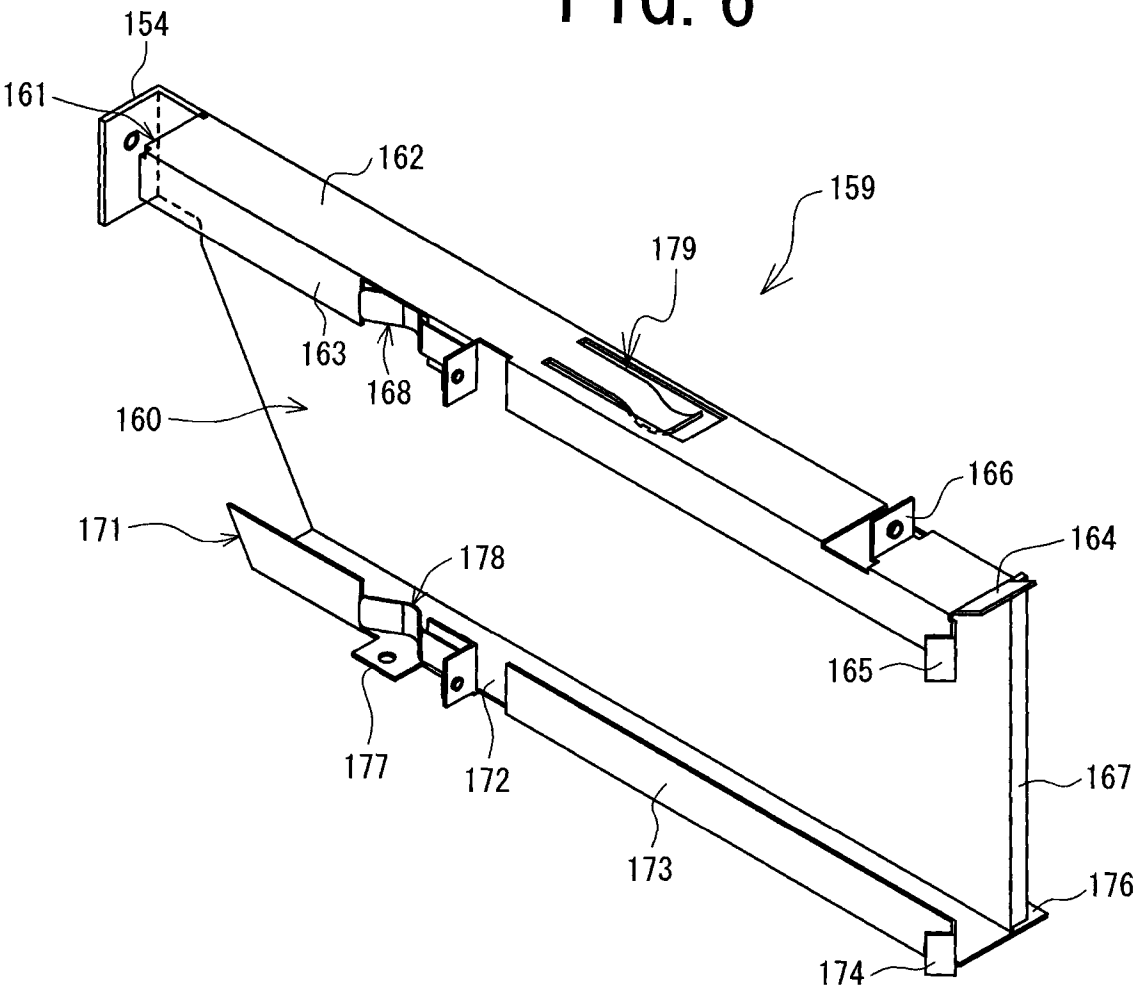
FIG. 6 is a perspective view of a holder 159.

As shown in FIG. 6, the upper rail portion 161 is a portion that protrudes to the left along an upper edge portion of the right guide portion 160. The upper rail portion 161 includes an upper guide portion 162 that extends in a substantially perpendicular direction to the left from the upper edge portion of the right guide portion 160, and an upper left guide portion 163 that extends downward in a substantially perpendicular direction from a left edge portion of the upper guide portion 162. The upper guide portion 162 is a portion that guides an upper end portion (more specifically, an outer surface of the top wall 32) of the case 2 when the cartridge 1 is inserted into the holder 159. The upper left guide portion 163 is a portion that guides an upper portion of a left end portion (more specifically, an outer surface of the left wall 30) of the case 2 when the cartridge 1 is inserted into the holder 159. A width (a length in the left-right direction) of the upper guide portion 162 is substantially the same as a width (a distance from the left side surface to the right side surface) of the case 2. Note that an upper spring portion 179 is provided in the vicinity of a central portion in the front-rear direction of the upper guide portion 162. The upper left guide portion 163 has a cut out section that is located to the rear of the center in the front-rear direction, and an upper spring portion 168 is provided in the cut out section.

An upper receiving portion 164 is connected to the front end of the upper guide portion 162. The upper receiving portion 164 is a portion that extends slightly upward toward the front from the front end of the upper guide portion 162. A first fixing tab 166, which has a screw hole and protrudes upward, is provided to the rear of the upper receiving portion 164 of an upper surface of the upper guide portion 162. Further, as shown in FIG. 9, an abutment portion 169 is provided at the rear end of the upper guide portion 162. The abutment portion 169 is a portion that bends and extends downward in a substantially perpendicular direction from the rear end of the upper guide portion 162. When the cartridge 1 is inserted in the holder 159, the abutment portion 169 abuts against the back surface portion 331 of the rear end of the cartridge 1 and thus restricts the cartridge 1 from moving further to the rear. An upper left receiving portion 165 is connected to the front end of the upper left guide portion 163. The upper left receiving portion 165 first extends forward and to the left from the front end of the upper left guide portion 163 and then bends rearward. The upper left receiving portion 165 is a portion that has a V shape when the holder 159 is viewed from above.

The lower rail portion 171 is a portion that protrudes to the left along a lower edge portion of the right guide portion 160. The lower rail portion 171 includes a lower guide portion 172 that extends in a substantially perpendicular direction to the left from the lower edge portion of the right guide portion 160, and a lower left guide portion 173 that extends upwardly in a substantially perpendicular direction from a left edge portion of the lower guide portion 172. The lower guide portion 172 is a portion that guides a lower end portion (more specifically, an outer surface of the bottom wall 31) of the case 2 when the cartridge 1 is inserted into the holder 159. The lower left guide portion 173 is a portion that guides a lower portion of the left end portion (more specifically, the outer surface of the left wall 30) of the case 2 when the cartridge 1 is inserted into the holder 159.

The lower guide portion 172 faces the upper guide portion 162 and extends in parallel with the upper guide portion 162. A distance between the upper guide portion 162 and the lower guide portion 172 is substantially the same as a height in the up-down direction (a distance from the top surface to the bottom surface) of the case 2. A width (a length in the left-right direction) of the lower guide portion 172 is substantially the same as the width (the distance from the left side surface to the right side surface) of the case 2. Note that the lower left guide portion 173 has a cut out section that is located to the rear of the center in the front-rear direction, and a lower spring portion 178 that is similar to the upper spring portion 168 is provided in the cut out section.

A second fixing tab 176, which has a screw hole (not shown in the drawings) and protrudes to the right, is provided at the right end of a front end portion of the lower guide portion 172. Further, a third fixing tab 177, which has a screw hole and protrudes to the left, is provided at the position of the lower guide portion 172 corresponding to a rear portion of the lower spring portion 178. A lower left receiving portion 174 is connected to the front end of the lower left guide portion 173. The lower left receiving portion 174 first extends slightly to the left toward the front from the front end of the lower left guide portion 173, and then bends rearward. The lower left receiving portion 174 is a portion that has a V shape when the holder 159 is viewed from above.

When the cartridge 1 is inserted in the holder 159, first, a rear end portion of the cartridge 1 is inserted from a front end portion of the holder 159, and the cartridge 1 moves toward the rear side of the holder unit 150 while the right side surface (the outer surface of the lid portion 4), the top surface (the outer surface of the top wall 32) and the lower surface (the outer surface of the bottom wall 31) of the case 2 are respectively guided by the right guide portion 160, the upper rail portion 161 and the lower rail portion 171. A movement direction when the cartridge 1 is removed from the holder 159 is an opposite direction to the movement direction when it is inserted. More specifically, the longitudinal direction of the right guide portion 160 and the extending direction of the upper rail portion 161 and the lower rail portion 171 are an insertion/removal direction of the cartridge 1 with respect to the cartridge mounting unit 110.

Assembling of the holder unit 150 will be explained with reference to FIG. 5. The holder unit 150 is assembled such that the eight holders 159 are placed on and fixed to the mounting plate 155 that is disposed in a substantially horizontal direction, and the holders 159 are each fixed to the fixing plate 152 and the fixing plate 158 that are disposed in a substantially vertical direction. The mounting plate 155, the fixing plate 152 and the fixing plate 158 are all thin plate members made of metal and have screw holes to fix the holders 159. The length of the mounting plate 155 in the left-right direction is slightly longer than the length of the eight cartridges 1 that are arranged side by side in the left-right direction, and the length of the mounting plate 155 in the front-rear direction is substantially the same as the length of the holder 159 in the front-rear direction. The length of the fixing plate 152 in the left-right direction is substantially the same as the length of the mounting plate 155 in the left-right direction, and the length of the fixing plate 152 in the up-down direction is slightly longer than that of the bent portion 154 (refer to FIG. 6) of the holder 159. The length of the fixing plate 158 in the left-right direction is substantially the same as the length of the mounting plate 155 in the left-right direction, and the length of the fixing plate 158 in the up-down direction is slightly longer than that of the first fixing tab 166 (refer to FIG. 6) of the holder 159.

First, the front and rear edges of the lower rail portions 171 of the eight holders 159 are aligned with the front and rear edges of the mounting plate 155, and the lower rail portions 171 are placed on the mounting plate 155 such that they are arranged at equal intervals in the left-right direction. The above-described second fixing tab 176 and third fixing tab 177 (refer to FIG. 6) of the holder 159 are each provided with the screw hole. Screws are sequentially fastened to the screw holes of the respective fixing portions and the screw holes of the mounting plate 155, and thus the holders 159 are fixed to the mounting plate 155. The holders 159 are arranged such that the fixing plate 152 abuts, from the rear, against the bent portion 154 provided in the rear end upper portion of the right guide portion 160 of each of the holders 159. The screws are fastened to the screw holes of the bent portions 154 and the fixing plate 152 and thus the holders 159 are fixed to the fixing plate 152. Further, the fixing plate 158 having eight screw holes is arranged such that the fixing plate 158 abuts, from the rear, against the first fixing tabs 166 that protrude above the upper guide portions 162. The screws are sequentially fastened to the screw holes of the first fixing tabs 166 and the fixing plate 158 and thus the holders 159 are fixed to the fixing plate 158. In this manner, the holder unit 150 shown in FIG. 5 is complete. In a state in which the front edge of the mounting plate 155 is arranged along the lower edge portion of the opening 112 (refer to FIG. 1) of the housing 111 and a plate surface of the mounting plate 155 is arranged in a substantially horizontal direction, the holder unit 150 is fixed to a frame 116 (refer to FIG. 8) that is provided on the rear side of the opening 112 inside the housing 111.

Figure 7:
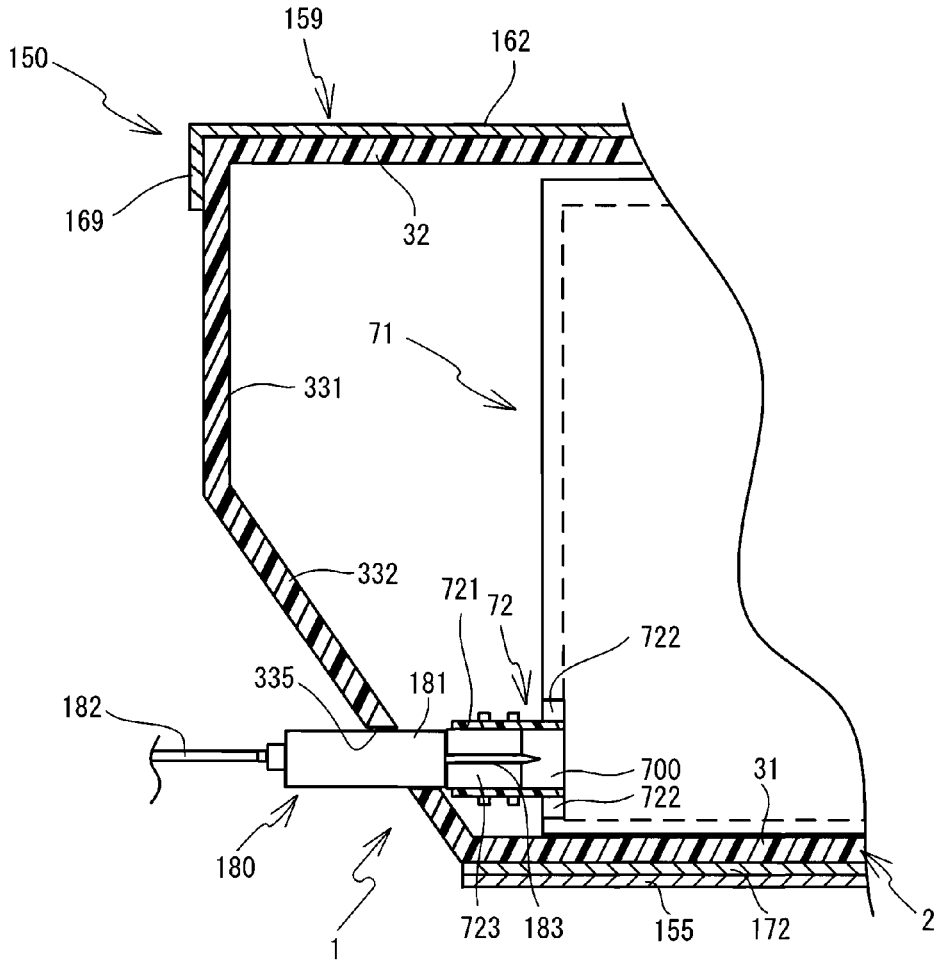
FIG. 7 is an enlarged partial cross-sectional view of a plug 72 of the ink cartridge 1 connected to a connection portion 180 and a surrounding portion of the plug 72.

Next, the connection portion 180 that is provided on the rear side of the holder unit 150 will be explained with reference to FIG. 7. Note that, in order to simplify the drawing, an illustration of the detection unit 130, which will be described later, and the like is omitted in FIG. 7. The connection portion 180 includes a cylindrically shaped fixing portion 181, the tube 182 that is connected to the fixing portion 181, and the lead-out needle 183 to draw out the ink. Note that, although in actuality the fixing portion 181 is fixed inside the housing 111, an illustration of a fixing portion is omitted. The number of the provided connection portions 180 is eight, corresponding to the eight holders 159. The lead-out needle 183 protrudes from a central portion at the front end of the fixing portion 181. One end of the tube 182 is connected to the rear end side of the fixing portion 181. The tube 182 extends inside the body portion 108 (refer to FIG. 1) via an opening (not shown in the drawings) on the right side of the housing 111, while the other end of the tube 182 is connected to the print head (not shown in the drawings).

In the course of the cartridge 1 being guided by the holder 159 and inserted into the holder unit 150, the lead-out needle 183 that protrudes to the front and a section of the fixing portion 181 enter the inside of the case 2 from the opening 335 provided in the inclined surface portion 332 of the cartridge 1. Then, the lead-out needle 183 pierces a central portion of the rubber plug 723 and thus the connection portion 180 is connected to the cartridge 1. As shown in FIG. 7, when the back surface portion 331 of the cartridge 1 abuts against the abutment portion 169 of the holder 159, the insertion of the cartridge 1 into the holder 159 is complete. At this time, the lead-out needle 183 passes through the rubber plug 723 and a leading end portion of the lead-out needle 183 is disposed inside the hollow portion 700. A hole, through which the ink flows, is provided at the leading end portion of the lead-out needle 183, and thus the ink in the ink bag 71 can be supplied to the print head through the hollow portion 700, the lead-out needle 183 and the tube 182.

Figure 8:
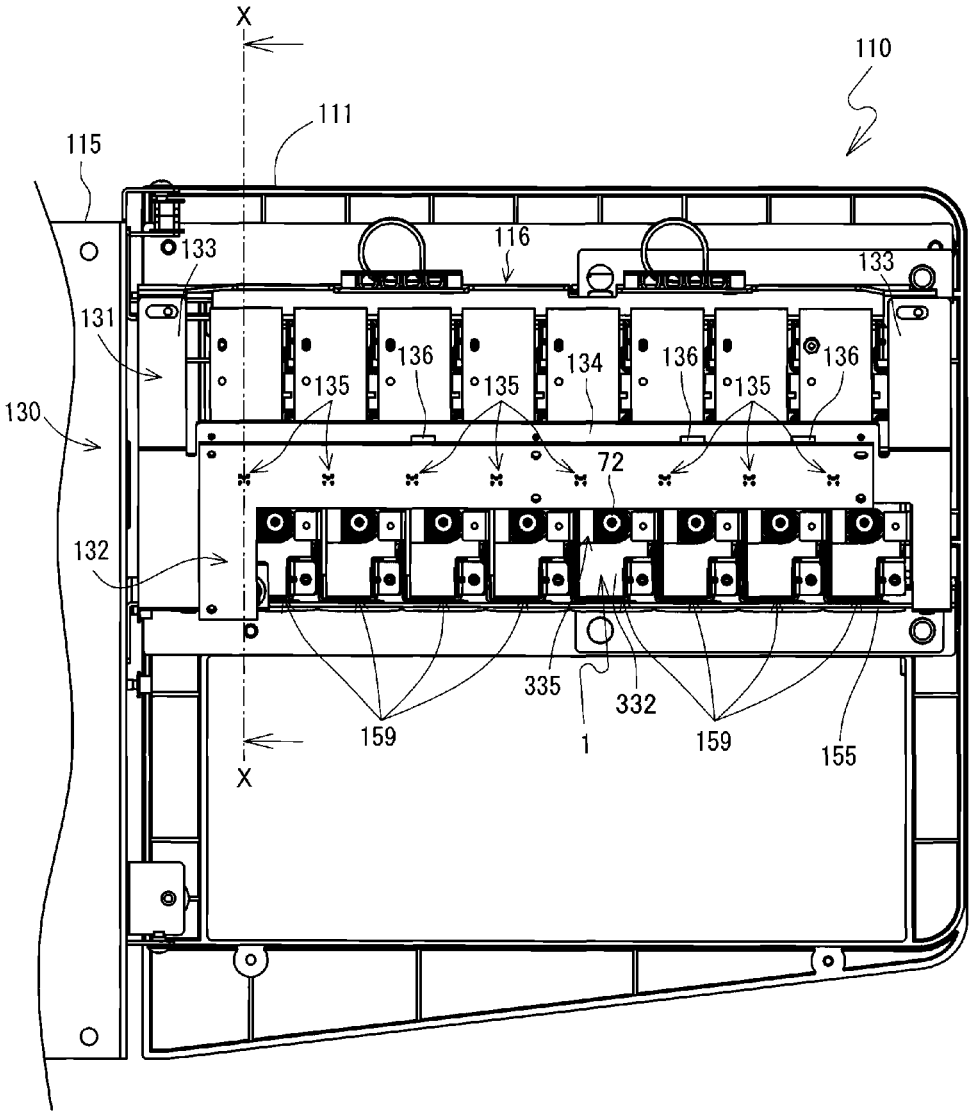
FIG. 8 is a rear view of a cartridge mounting unit 110 in a state in which a door portion 115 is opened.

Next, the detection unit 130 that is provided on the rear side of the holder unit 150 will be explained with reference to FIG. 8 to FIG. 15. Note that, although an illustration of the above-described connection portion 180 (refer to FIG. 7) is omitted in FIG. 8, actually the connection portion 180 is provided in a position corresponding to the plug 72 of each of the cartridges 1. As shown in FIG. 8 and FIG. 9, the detection unit 130 is provided with a switch support plate 132 made of metal, eight detection switches 250 that are supported by the switch support plate 132, a protruding portion support plate 131 made of metal, and eight transmission members 200 that are supported by the protruding portion support plate 131. Note that the switch support plate 132 is a substrate on which functional components other than the detection switches 250 are also installed.

As shown in FIG. 8, the switch support plate 132 is a laterally disposed L-shaped thin plate member that is long in the left-right direction. The protruding portion support plate 131 is an H-shaped thin plate member, and includes two arm portions 133 that extend in a substantially vertical direction and a support portion 134 that connects central portions of the arm portions 133 in the left-right direction. As show in FIG. 9, the protruding portion support plate 131 is formed such that the arm portions 133 are gently curved at an upper portion of the support portion 134. Further, the protruding portion support plate 131 is formed such that upper portions of the two arm portions 133 are arranged in the up-down direction and fixed to the frame 116 (refer to FIG. 8) so that the support portion 134 extends diagonally downward and forward. The support portion 134 is arranged at an angle at which the support portion 134 is substantially in parallel with the inclined surface portion 332 of the cartridge 1 when the cartridge 1 is inserted in the holder 159. In order for the switch support plate 132 to face the support portion 134, the switch support plate 132 is fixed to the protruding portion support plate 131 by a plurality of coupling portions 136 (refer to FIG. 8) in a state in which the switch support plate 132 is separated from the support portion 134 diagonally downward and rearward. Note that the width of the support portion 134 in the up-down direction is larger than that of the switch support plate 132. In other words, a surface of the switch support plate 134 that faces the switch support plate 132 is larger than a surface of the switch support plate 132 that faces the support portion 134.

Figure 10:
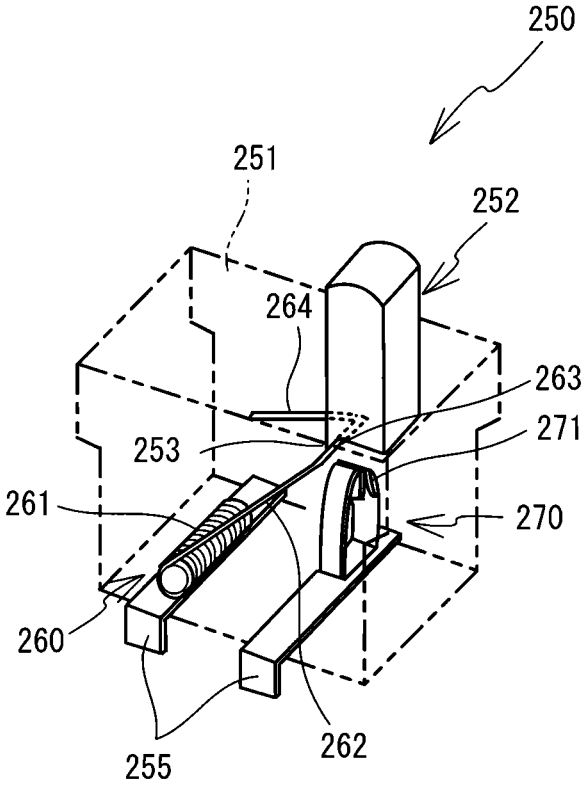
FIG. 10 is an explanatory view of an internal structure of the detection switch 250.

A structure of the detection switch 250 that is attached to the switch support plate 132 will be explained with reference to FIG. 10 to FIG. 13. As shown in FIG. 10, the detection switch 250 is provided with a case 251, a slider 252, a torsion coil spring (hereinafter simply referred to as a torsion spring) 260, a clip 270 and terminal portions 255.

The slider 252 penetrates and is supported by the case 251 such that the slider 252 can be slidingly displaced in the up-down direction via a through hole provided in the case 251 having a substantially rectangular parallelepiped shape. A lower end portion of the slider 252 is provided with an engagement portion 253 that engages with a receiving portion 263 of the torsion spring 260, which will be described later. The torsion spring 260 includes a winding portion 261, an extending portion 262, the receiving portion 263 and a movable contact portion 264. The extending portion 262 linearly extends from one end of the winding portion 261 in a direction substantially orthogonal to an axial direction of the winding portion 261. The receiving portion 263 extends from the leading end of the extending portion 262 such that it curves in the axial direction of the winding portion 261. The movable contact portion 264 curves from the leading end of the receiving portion 263 toward the winding portion 261, and extends at a certain angle with respect to the extending portion 262. The slider 252 and the torsion spring 260 are formed such that, as the slider 252 moves downward, the engagement portion 253 presses against the receiving portion 263.

The pair of belt-shaped terminal portions 255 are arranged substantially in parallel with each other on a bottom portion of the interior of the case 251, and both ends of each of the terminal portions 255 protrude from the case 251. The torsion spring 260 is arranged on one of the terminal portions 255, and a lower portion of the winding portion 261 is in contact with the terminal portion 255. Further, a base end portion of the clip 270, which is a fixed contact, is fixed on the other terminal portion 255. The clip 270 includes a fixed contact portion 271 that is formed such that leading ends of a pair of plate portions, which extend upward from the base end portion of the clip 270 and which face each other, are folded in a direction to move closer to each other.

Figure 11:
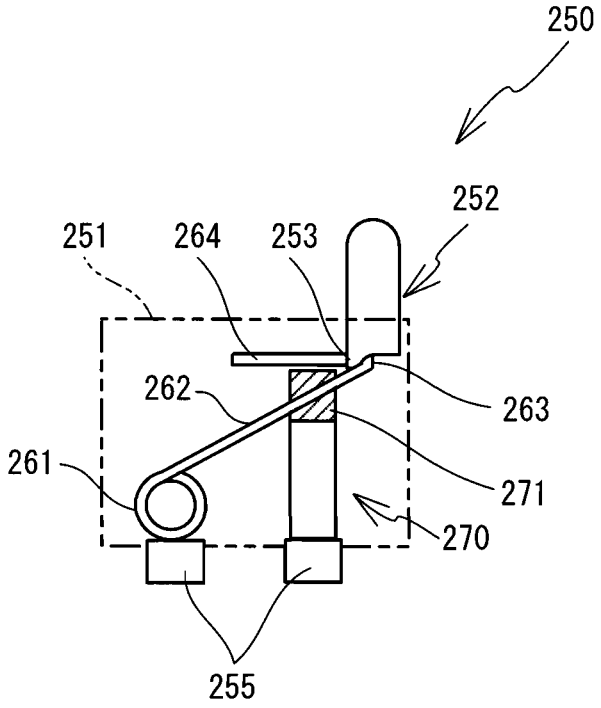
FIG. 11 is a first explanatory view of the operation of the detection switch 250.
Figure 12:
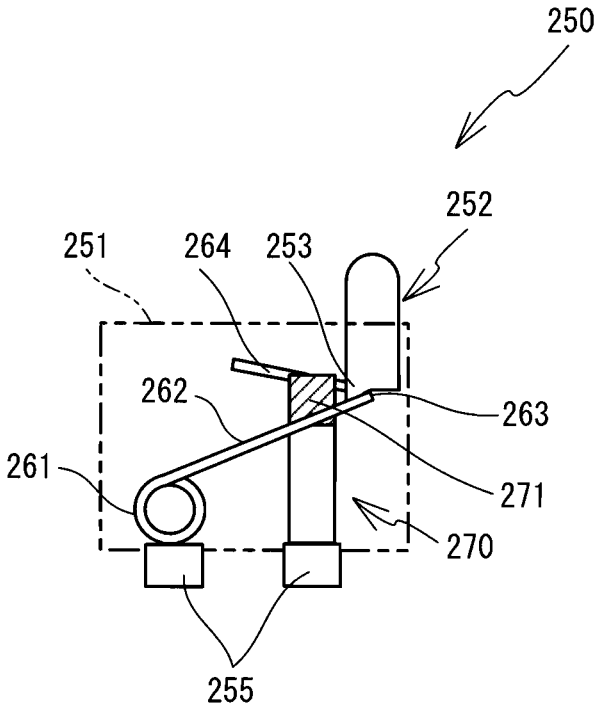
FIG. 12 is a second explanatory view of the operation of the detection switch 250.

The slider 252 is urged by the torsion spring 260 in a direction (hereinafter referred to as a protruding direction) in which a leading end portion of the slider 252 protrudes to the outside from the case 251. As shown in FIG. 11, in a state in which an external force does not act on the slider 252, the movable contact portion 264 of the torsion spring 260 is separated from the fixed contact portion 271 of the clip 270, and the detection switch 250 is maintained in an OFF state. On the other hand, when the leading end portion of the slider 252 is pressed and the slider 252 moves in a direction (hereinafter referred to as a receding direction) that is opposite to the protruding direction, the engagement portion 253 presses the receiving portion 263 and the torsion spring 260 is deformed. When a movement amount of the slider 252 in the receding direction exceeds a predetermined amount, the movable contact portion 264 comes into contact with the fixed contact portion 271 in accordance with the deformation of the torsion spring 260, as shown in FIG. 12. The position of the slider 252 at this point in time is referred to as an operation position. As a result, current flows between the pair of terminal portions 255 via the torsion spring 260 and the clip 270, and the detection switch 250 is changed to an ON state.

Figure 13:
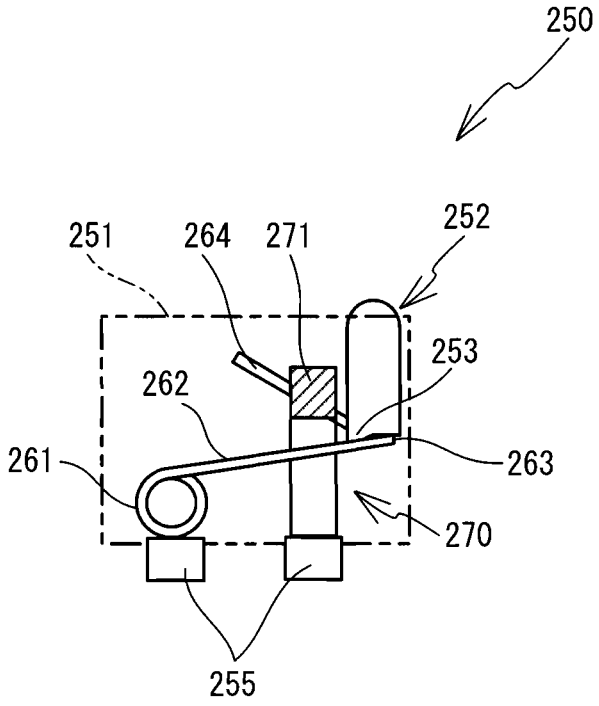
FIG. 13 is a third explanatory view of the operation of the detection switch 250.

When the slider 252 is further pressed and reaches a limit position where the slider 252 cannot move any more as shown in FIG. 13, the movable contact portion 264 is clamped by the fixed contact portion 271. When the slider 252 is located between the operation position and the limit position, the detection switch 250 is maintained in the ON state. A range from the operation position to the limit position is referred to as an operation range of the detection switch 250. After that, when the pressing of the slider 252 is released, the slider 252 is urged in the protruding direction and is restored to an initial position shown in FIG. 11 due to an elastic force of the torsion spring 260. In the course of being restored from the limit position to the initial position, the movable contact portion 264 separates from the fixed contact portion 271, and thus the detection switch 250 is changed to the OFF state.

Figure 14:
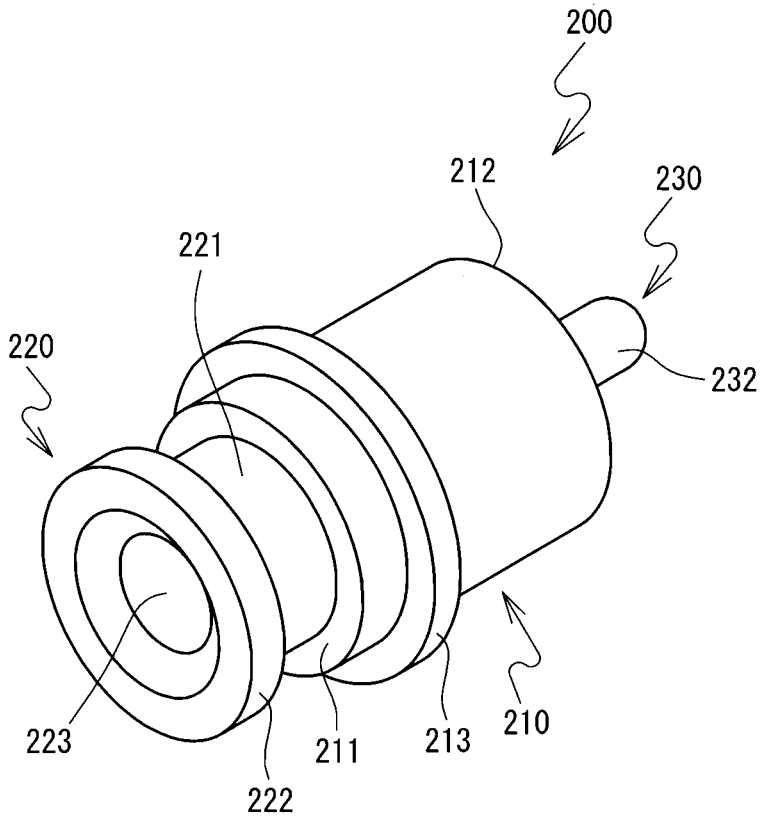
FIG. 14 is a perspective view of the transmission member 200.
Figure 15:
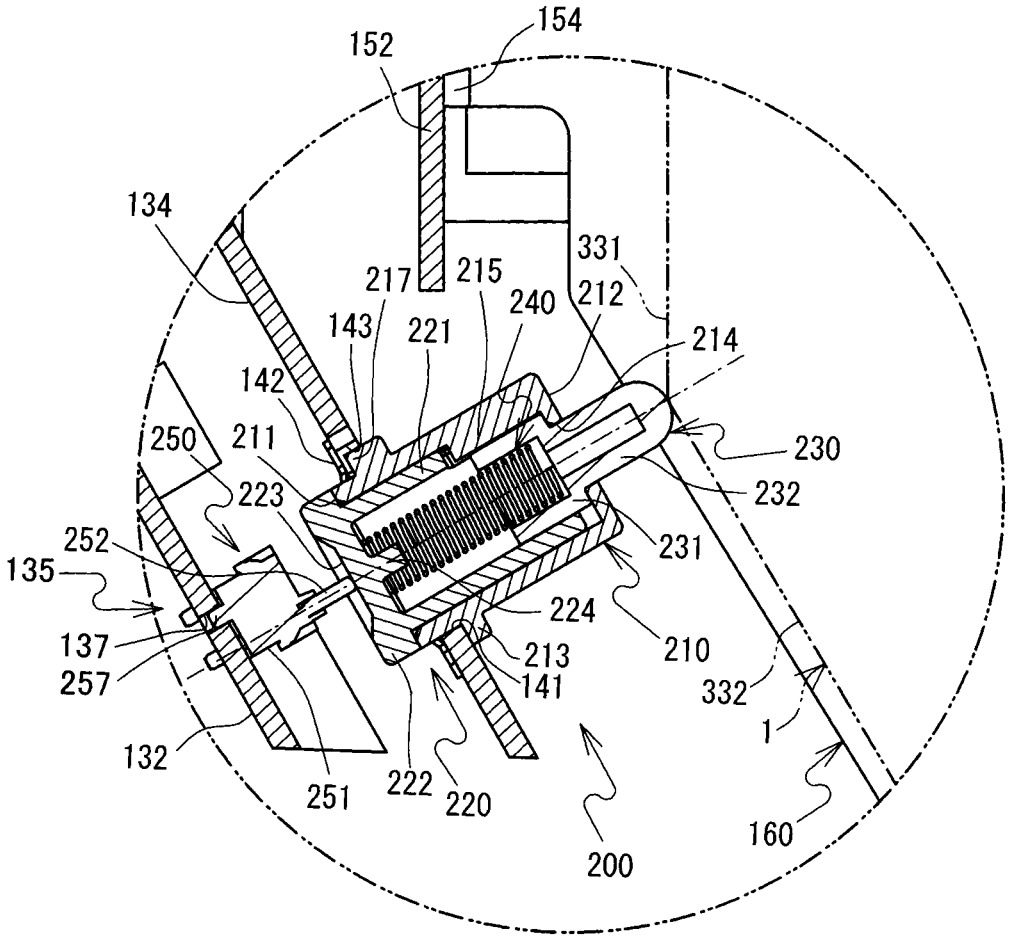
FIG. 15 is an enlarged view of a section A shown in FIG. 9.

A schematic structure of the transmission member 200, which is attached to the protruding portion support plate 131, will be explained with reference to FIG. 14 and FIG. 15. As shown in FIG. 14 and FIG. 15, the transmission member 200 is provided with a case 210, a sliding member 220, a protruding portion 230 and a compression coil spring (hereinafter simply referred to as a compression spring) 240. The case 210 has a cylindrical shape. The sliding member 220 and the protruding portion 230 are slidably inserted in the inside of the case 210. The compression spring 240 is interposed between the sliding member 220 and the protruding portion 230.

One of both end portions of the cylindrically shaped case 210 is open, and the other end portion is blocked by a wall portion having a through hole 214. Hereinafter, the end portion of the case 210 that is open is referred to as a first end portion 211, and the end portion of the wall portion provided with the through hole 214 is referred to as a second end portion 212. Further, the case 210 includes a flange portion 213 in the vicinity of the first end portion 211. The flange portion 213 protrudes circumferentially outward from an outer peripheral surface of the case 210. A section of the flange portion 213 is provided with a protrusion 217 that protrudes to the first end portion 211 side. An inner peripheral surface of the case 210 is provided with a projection 215 that extends from the second end portion 212 toward the first end portion 211 as far as a central portion of the case 210.

The sliding member 220 is slidably inserted in the inside of the case 210 along an axial direction of the case 210. The sliding member 220 includes a cylindrical portion 221, an abutment portion 222, a recessed portion 223 and a protrusion 224. The cylindrical portion 221 has a cylindrical shape having an outer diameter that is substantially the same as an inner diameter of the case 210. The cylindrical portion 221 can slide along the axial direction of the case 210 inside the case 210. The abutment portion 222 is a disc-shaped portion having an outer diameter that is substantially the same as an outer diameter of the case 210. The abutment portion 222 is connected to one end portion of the cylindrical portion 221 and blocks an opening of the cylindrical portion 221. The recessed portion 223 is formed in a surface (an outer surface) of the abutment portion 222 that is on an opposite side to the cylindrical portion 221. The protrusion 224 is provided in a central portion of a surface (an inner surface) of the abutment portion 222 on the cylindrical portion 221 side such that the protrusion 224 protrudes in an axial direction of the cylindrical portion 221. The cylindrical portion 221 of the sliding member 220 is inserted inside the case 210 from an opening of the first end portion 211 of the case 210. Note that a groove that engages with the projection 215 of the case 210 is provided on a leading end side of the cylindrical portion 221, and thus the sliding member 220 is inhibited from rotating inside the case 210.

The protruding portion 230 is arranged on the second end portion 212 side of the case 210 such that it can slide along the axial direction of the case 210. The protruding portion 230 includes an insertion portion 231 and a contact portion 232. The insertion portion 231 has a cylindrical shape having an outer diameter that is substantially the same as an inner diameter of the cylindrical portion 221 of the sliding member 220.

The insertion portion 231 is inserted inside the cylindrical portion 221 such that it can slide along the axial direction of the case 210. The contact portion 232 has an outer diameter that is smaller than that of the insertion portion 231 and protrudes from one end portion of the insertion portion 231 to the outside of the case 210 via the through hole 214 formed in the second end portion 212 of the case 210. The leading end of the contact portion 232 is round.

The compression spring 240 is arranged between the sliding member 220 and the protruding portion 230. The compression spring 240 has a coil diameter that is substantially the same as an inner diameter of the insertion portion 231 of the protruding portion 230. One end of the compression spring 240 is inserted inside the insertion portion 231, and the protrusion 224 of the sliding member 220 is inserted on the inner side of the other end. The compression spring 240 urges the protruding portion 230 in a direction (hereinafter referred to as a protruding direction) in which the contact portion 232 protrudes from the through hole 214 to the outside of the case 210. A modulus of elasticity of the compression spring 240 is smaller than a modulus of elasticity of the torsion spring 260 of the detection switch 250.

An arrangement of the detection switches 250 and the transmission members 200 with respect to the switch support plate 132 and the protruding portion support plate 131, and assembling of the detection unit 130 will be explained with reference to FIG. 8 and FIG. 15. The eight detection switches 250 and the eight transmission members 200 (refer to FIG. 15) are respectively attached to the switch support plate 132 and the supporting portion 134 of the protruding portion support plate 131 such that they are at equal intervals in the left-right direction. More specifically, each of the arrangement positions on the switch support plate 132 and the support portion 134 is determined so that an upper left end portion of the inclined surface portion 332 presses the contact portion 232 of the transmission member 200 when the cartridge 1 is inserted into the holder 159. Further, the transmission member 200 and the detection switch 250 are arranged as one set, as shown in FIG. 15. More specifically, the transmission member 200 and the detection switch 250 are arranged such that the axis line of the case 210 of the transmission member 200, namely, the protruding direction of the protruding portion 230, matches the protruding direction of the slider 252 of the detection switch 250 and also such that the protruding direction of the protruding portion 230 and the slider 252 is substantially perpendicular to the inclined surface portion 332 of the cartridge 1.

As shown in FIG. 8, the switch support plate 132 is provided with eight attachment portions 135 in positions where the eight detection switches 250 are attached. Each of the attachment portions 135 is formed by five through holes including an attachment hole 137 and four through holes. As shown in FIG. 15, an attachment protrusion 257 that protrudes from a bottom surface of the case 251 is fitted into the attachment hole 137. The both end portions of the pair of terminal portions 255 (refer to FIG. 10) that protrude from the case 251 of the detection switch 250 are respectively inserted into the four through holes. The four end portions of the terminal portions 255 and the attachment protrusion 257 are inserted into the five through holes that form the attachment portion 135. Then, the four end portions of the terminal portions 255 are soldered from a back surface (a surface on the opposite side to the surface facing the support portion 134) side of the switch support plate 132. Thus, each of the detection switches 250 is fixed to the switch support plate 132. Note that the eight attachment portions 135 corresponding to the eight cartridges 1 are respectively located diagonally above (not directly above) the positions in which the plugs 72 of the cartridges 1 are arranged.

The support portion 134 of the protruding portion support plate 131 is provided with eight through holes 141 (refer to FIG. 15) in positions where the eight transmission members 200 are respectively attached. The support portion 134 is provided with a cut-out portion 143 into which the protrusion 217 of the flange portion 213 of the case 210 is fitted. The cut-out portion 143 is provided to be continuous with the through hole 141. A rubber holding member 142 is provided on a surface facing the switch support plate 132, along an outer periphery of the through hole 141.

The transmission member 200 is assembled according to the following procedure and is attached to the support portion 134. First, the protruding portion 230 is inserted from the opening of the first end portion 211 of the case 210 such that the leading end of the contact portion 232 protrudes from the through hole 214. Next, one end portion of the compression spring 240 is inserted into the inside of the insertion portion 231. In this state, the protrusion 217 of the flange portion 213 of the case 210 is aligned with the cut-out portion 143 of the support portion 134, and the first end portion 211 of the case 210 is inserted into the through hole 141 from a side opposite to the surface facing the switch support plate 132. The protrusion 217 fits into the cut-out portion 143 and the flange portion 213 abuts against the support portion 134. At the same time, the case 210 is held by the holding member 142 in a state in which the case 210 is fitted with the through hole 141. After that, the sliding member 220 is inserted from the opening of the first end portion 211 such that the groove of the cylindrical portion 221 is engaged with the projection 215 provided inside the case 210. The insertion portion 231 is inserted into the cylindrical portion 221 and the protrusion 224 is inserted into the one end of the compression spring 240. When the sliding member 220 is inserted into the case 210 until the abutment portion 222 abuts against the first end portion 211 of the case 210, the attachment of the transmission member 200 is complete.

After the eight transmission members 200 are attached to the support portion 134 in this manner, the switch support plate 132 to which the eight detection switches 250 have been attached is coupled by the coupling portions 136 (refer to FIG. 8) and fixed. Thus, the detection unit 130 is complete. Note that, when the switch support plate 132 is coupled by the coupling portions 136, the coupling is performed such that the leading end of the slider 252 of each of the detection switches 250 comes into contact with the recessed portion 223 (refer to FIG. 15) of the transmission member 200 and the axis line of the case 210 matches the protruding direction of the slider 252 of each of the detection switches 250. After that, the detection unit 130 is attached to the frame 116 (refer to FIG. 8).

Figure 9:
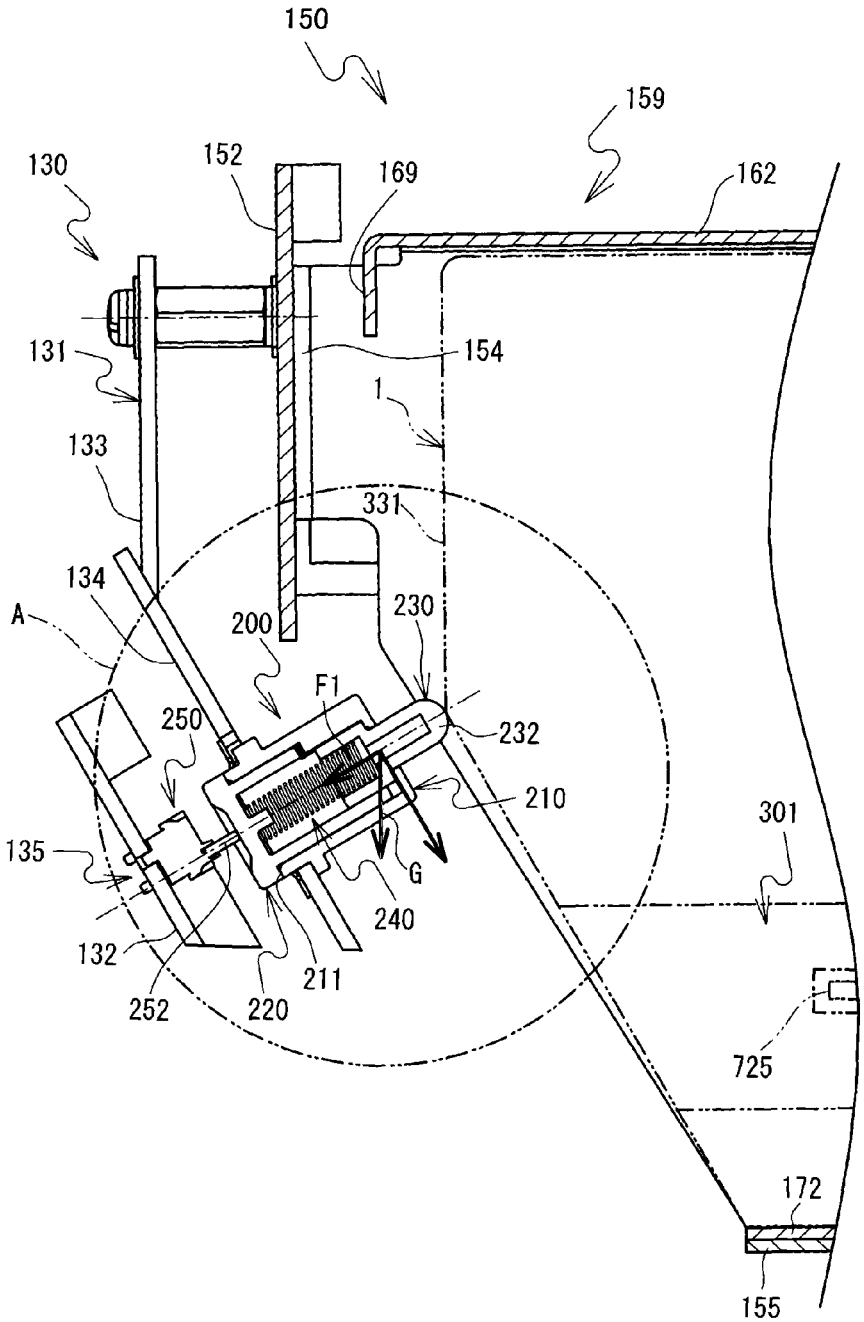
FIG. 9 is a first explanatory view of operations of a transmission member 200 and a detection switch 250 corresponding to a cross-section taken along a line X-X in FIG. 8 and as seen in the direction of arrows.

Note that, when the transmission member 200 is attached to the support portion 134 in the manner described above, the protruding direction of the protruding portion 230 is not the horizontal direction but a diagonally upward direction, as shown in FIG. 9. In this case, a weight G of the protruding portion 230 itself acts on the protruding portion 230. To address this, the compression spring 240 is adjusted such that it urges the protruding portion 230 in the protruding direction by a force which is larger than a component F1 in an axial direction (more specifically, a direction opposite to the protruding direction) of the weight G of the protruding portion 230 itself and which is smaller than a force that deforms the torsion spring 260 (refer to FIG. 10) of the detection switch 250. With this adjustment, the pressing force applied to the contact portion 232 can be more accurately transmitted to the detection switch 250 (more specifically, the slider 252).

Hereinafter, operations of the transmission member 200 and the detection switch 250 that detect whether the cartridge 1 is inserted in the holder 159 will be explained with reference to FIG. 9, FIG. 11 to FIG. 13, and FIG. 15 to FIG. 19. As shown in FIG. 9 and FIG. 15, in a state in which the cartridge 1 is not inserted in the holder 159 and the contact portion 232 of the transmission member 200 is not pressed, the contact portion 232 protrudes further to the front than the position (the position indicated by a two dotted line in FIG. 18) in which the inclined surface portion 332 of the cartridge 1 is to be arranged in an inserted state. At this time, the slider 252 of the detection switch 250 is in the initial position and the slider 252 is in contact with the recessed portion 223 but is not pressed. More specifically, as shown in FIG. 11, the torsion spring 260 of the detection switch 250 is not deformed and the movable contact portion 264 does not come into contact with the fixed contact portion 271 of the clip 270. Therefore, the detection switch 250 is in the OFF state.

After that, the cartridge 1 is inserted into one of the holders 159 thorough the opening 112 (refer to FIG. 1) of the cartridge mounting unit 110 and is pressed toward the rear side. In response to this, before the back surface portion 331 located at the rear end portion of the cartridge 1 abuts against the abutment portion 169 and the insertion is complete, the vicinity of a boundary between the back surface portion 331 and the inclined surface portion 332 comes into contact with the contact portion 232, as shown by a two dotted line in FIG. 9 and FIG. 15. Note that, before and after this timing, the lead-out needle 183 (refer to FIG. 7) of the connection portion 180 that is arranged below the detection switch 250 and the transmission member 200 starts to enter the space inside the leg portion 301 via the opening 335 (refer to FIG. 2). When the cartridge 1 is further pressed into the space, the inclined surface portion 332 presses the contact portion 232 of the compression spring 240. As a result, the contact portion 232 moves in an opposite direction (hereinafter referred to as a receding direction) to the protruding direction along the axial direction of the case 210, and the compression spring 240 starts to be compressed and deformed. The modulus of elasticity of the compression spring 240 is smaller than the modulus of elasticity of the torsion spring 260 that urges the slider 252 in the protruding direction in the detection switch 250. Therefore, the sliding member 220 does not move until the compression spring 240 is deformed by a predetermined amount.

Figure 16:
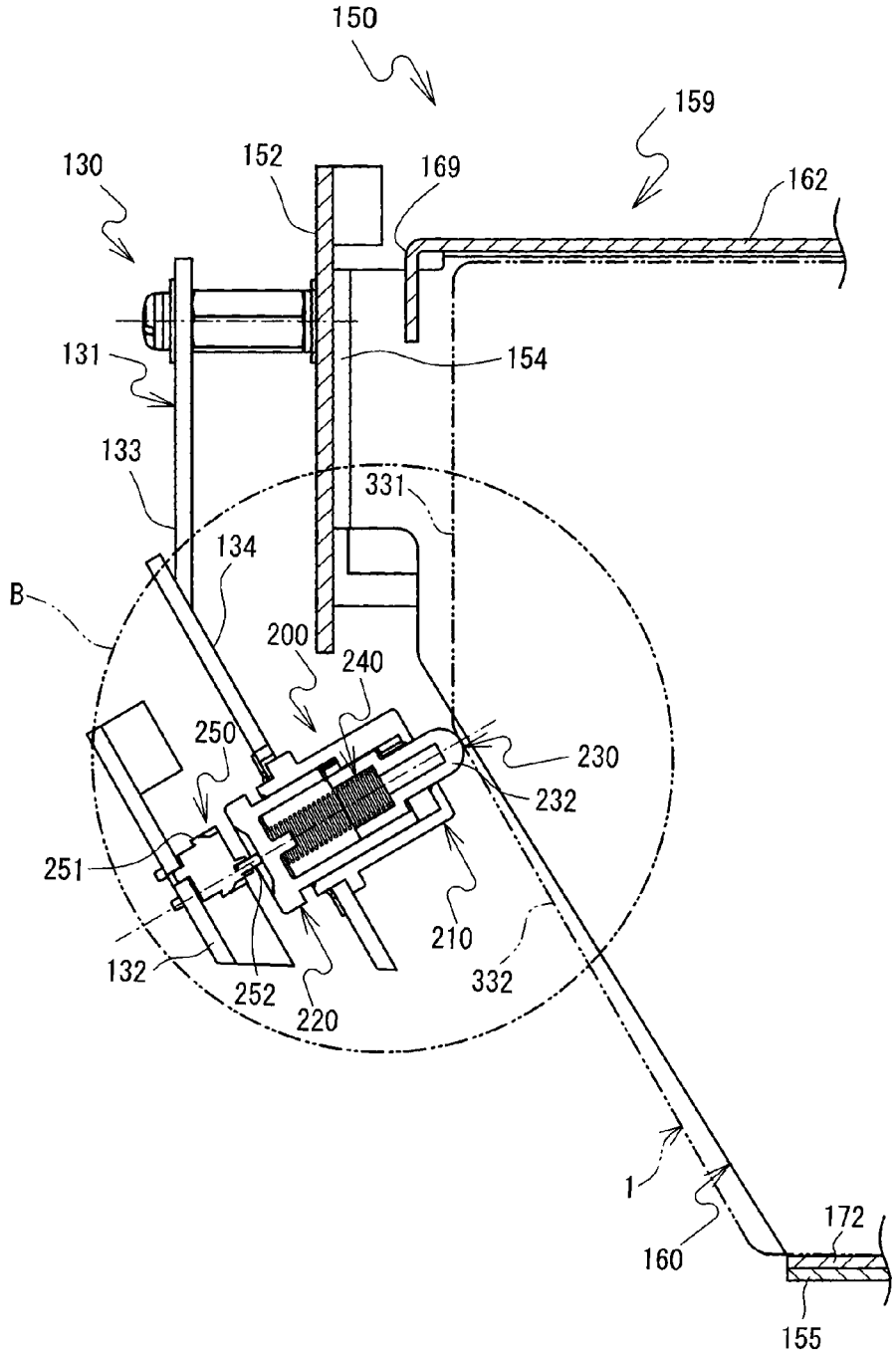
FIG. 16 is a second explanatory view of the operations of the transmission member 200 and the detection switch 250.
Figure 17:
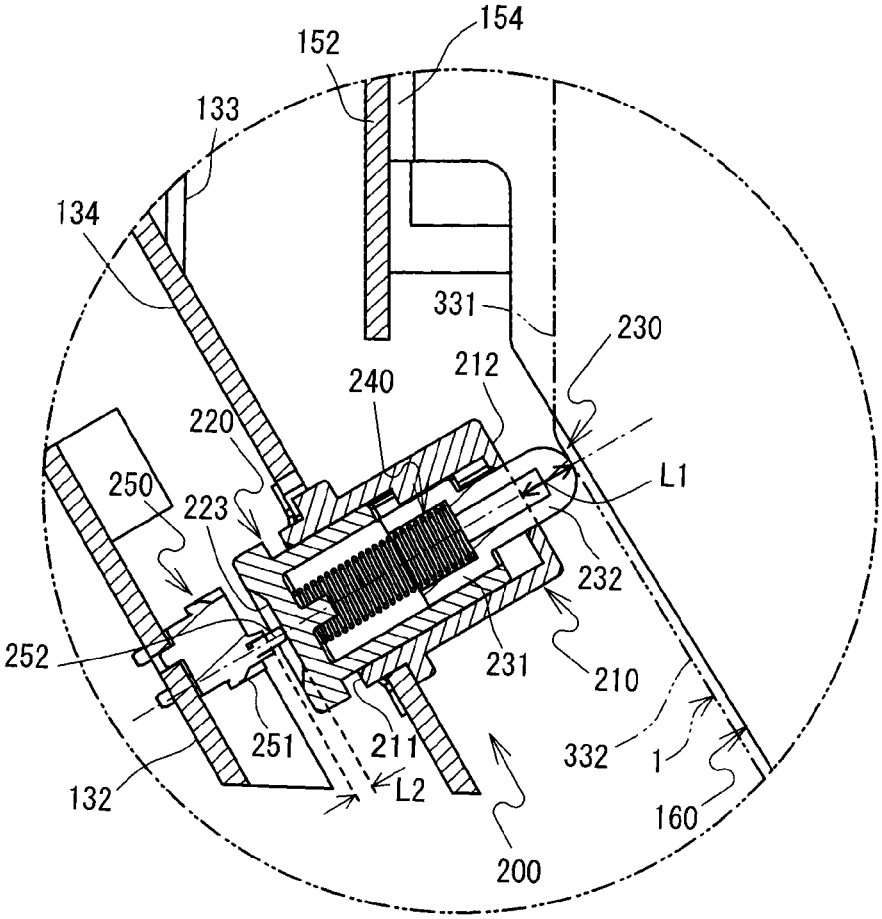
FIG. 17 is an enlarged view of a section B shown in FIG. 16.
Figure 18:
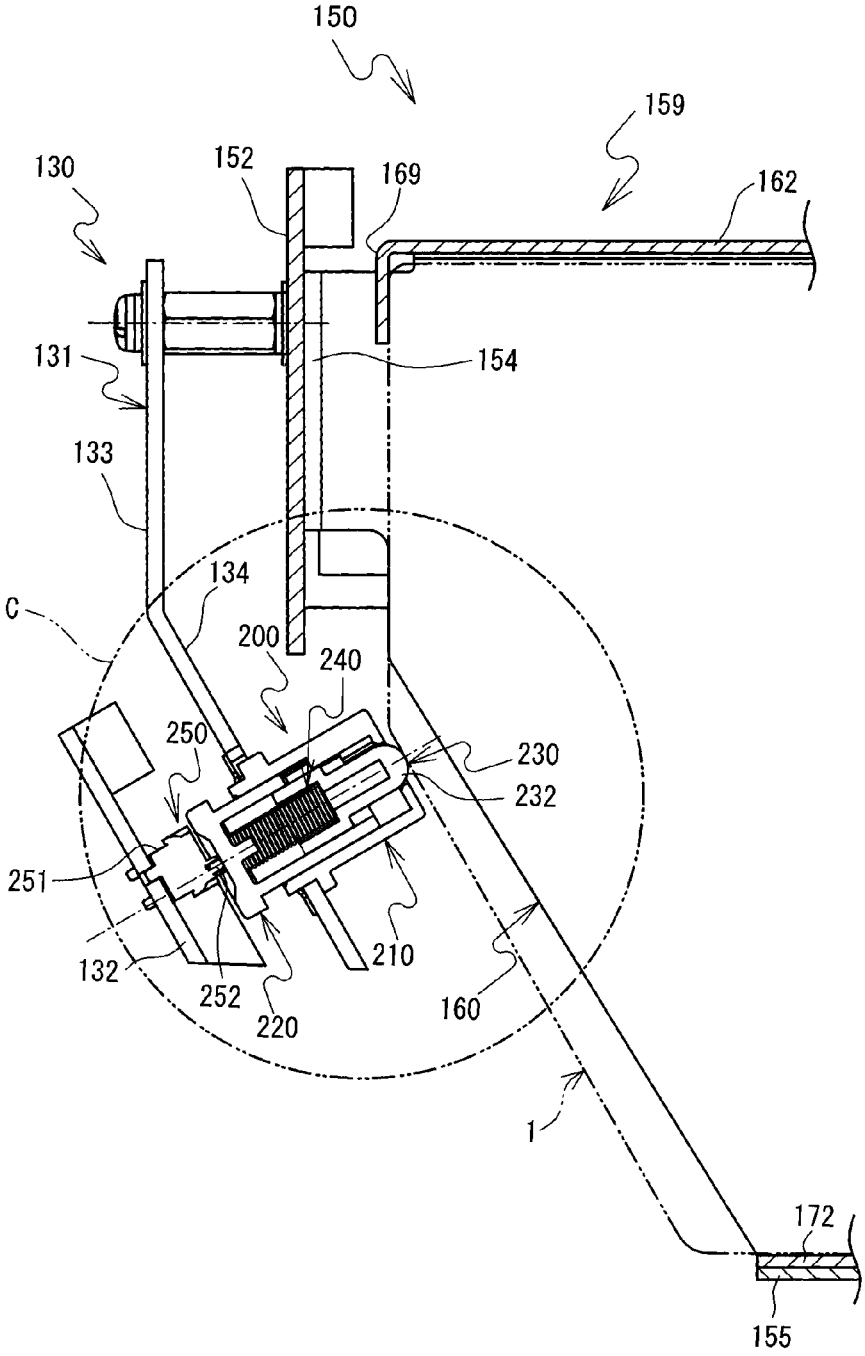
FIG. 18 is a third explanatory view of the operations of the transmission member 200 and the detection switch 250.
Figure 19:
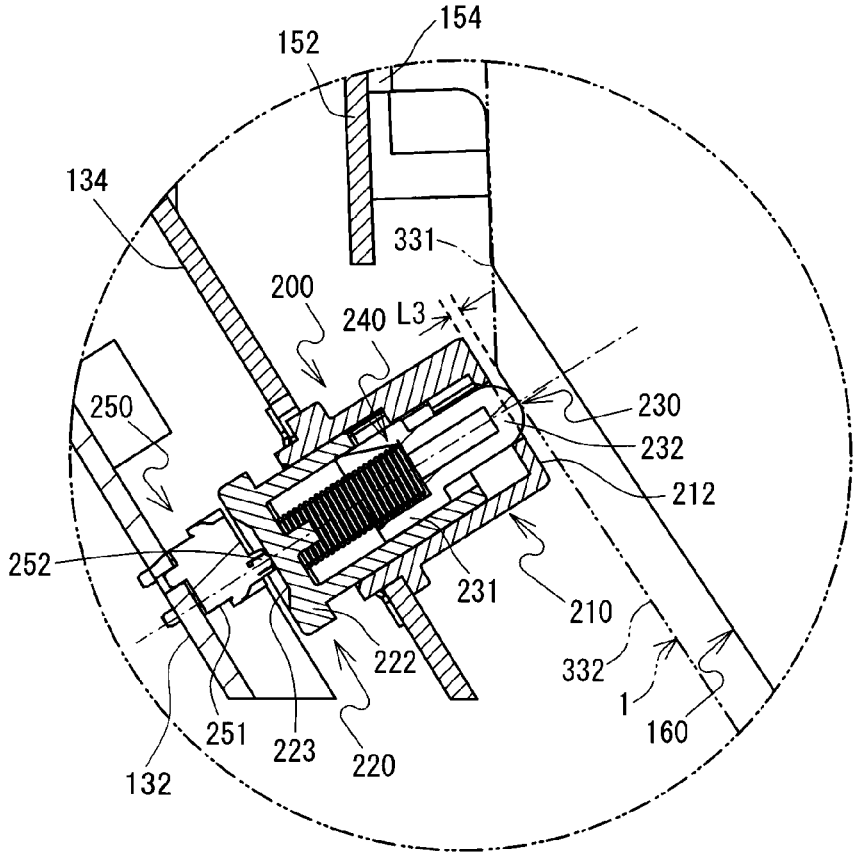
FIG. 19 is an enlarged view of a section C shown in FIG. 18.

When the compression spring 240 is deformed by the predetermined amount or more, the urging force applied to the sliding member 220 due to the elastic force of the compression spring 240 increases. Then, as shown in FIG. 16 and FIG. 17, the sliding member 220 moves toward the detection switch 250 along the axial direction of the case 210, and presses the leading end portion of the slider 252 that comes into contact with the recessed portion 223. Since the leading end portion of the slider 252 is pressed, the torsion spring 260 is deformed and the slider 252 moves in the receding direction. When the movement amount of the slider 252 from the initial position exceeds a predetermined amount and the slider 252 reaches the operation position (refer to FIG. 12), the detection switch 250 is changed to the ON state. When the cartridge 1 is further pressed and the back surface portion 331 abuts against the abutment portion 169 of the holder 159 as shown in FIG. 18 and FIG. 19, the insertion is complete. At this time, most of the contact portion 232 moves back into the case 210 and the slider 252 reaches the limit position (refer to FIG. 13). More specifically, from the state shown in FIG. 16 and FIG. 17 to the state shown in FIG. 18 and FIG. 19, the detection switch 250 is in the operation range and is in the ON state. Thus, it is possible to detect that the cartridge 1 is inserted.

As described above, the modulus of elasticity of the compression spring 240 that is interposed between the sliding member 220 and the protruding portion 230 in the transmission member 200 is smaller than the modulus of elasticity of the torsion spring 260 that urges the slider 252 in the protruding direction in the detection switch 250. Therefore, the movement amount of the slider 252 is smaller than the movement amount of the protruding portion 230 that is pressed by the cartridge 1.

When comparing the movement amount of the protruding portion 230 and the movement amount of the slider 252 in the operation range of the detection switch 250, the following result is obtained. As shown in FIG. 17, when the slider 252 is in the operation position, the length of protrusion of the protruding portion 230 (more specifically, the contact portion 232) from the second end portion 212 is denoted as L1, and the length of protrusion of the slider 252 from the upper end of the case 251 is denoted as L2. As shown in FIG. 19, when the slider 252 is in the limit position, the length of protrusion of the protruding portion 230 is denoted as L3. Note that, when the slider 252 is in the limit position, the length of protrusion of the slider 252 is zero. Therefore, the movement amounts of the protruding portion 230 and the slider 252 in the operation range are L1-L3 (namely, the length obtained by subtracting L3 from L1) and L2, respectively. In this example, the movement amount of the protruding portion 230 is twice the movement amount of the slider 252.

In other words, since the printer 100 according to the present embodiment uses the detection switch 250 and the transmission member 200 to detect whether the cartridge 1 is inserted, the range in which the detection is possible is twice the range used when the detection switch 250 only is provided for the detection. With the detection switch 250 only, the range in which the detection is possible is narrow. Therefore, there is a possibility that, even when the cartridge 1 is only slightly displaced from a completely inserted state, it may be determined that the cartridge 1 is not inserted. However, as in the present embodiment, when the displaceable protruding portion 230 is provided on the leading end side of the slider 252 of the detection switch 250 via the compression spring 240 and the torsion spring 260 of the detection switch 250 is deformed when the compression spring 240 is deformed by a predetermined amount or more, it is possible to reliably detect whether the cartridge 1 is inserted.

Further, since it is possible to insert the eight cartridges 1 in the printer 100, the eight holders 159 are provided to insert the cartridges 1 therein. Further, eight sets of the detection switch 250 and the transmission member 200 are provided corresponding to the eight holders 159 in order to detect whether the cartridges 1 are inserted. The eight detection switches 250 are supported by the common switch support plate 132. The eight transmission members 200 are supported by the support portion 134 of the common protruding portion support plate 131. By using the common members in this manner, it is possible to reduce the number of components while making it possible to use the plurality of cartridges 1.

Further, the support portion 134 having a plate surface that is larger than the switch support plate 132 is arranged between the holders 159 and the switch support plate 132, which is the substrate that supports the detection switches 250. Accordingly, even if the ink leaks from the cartridge 1 inserted in the holder 159, it is possible to inhibit the ink from adhering to the switch support plate 132 due to the support portion 134. Further, the detection switch 250 and the transmission member 200 are provided above the position in which the connection portion 180 or the plug 72 of the cartridge 1 is arranged. Normally, the ink that has leaked drops downward and it is therefore possible to inhibit the ink from adhering to the detection switch 250 and the transmission member 200 that are provided above the plug 72. Further, the detection switch 250 and the transmission member 200 are arranged not above the plug 72, but diagonally upward with respect to the plug 72. Therefore, even if the ink scatters when the cartridge 1 whose ink is leaking from the plug 72 is inserted in the holder 159, it is possible to further reduce the possibility of the ink adhering to the detection switch 250 and the transmission member 200.

The present disclosure is not limited to the above-described embodiment and various modifications are possible. Hereinafter, examples of the modifications that can be added to the above-described embodiment will be explained. For example, the detection switch 250 need not necessarily have the structure exemplified in the embodiment. It is sufficient if the detection switch 250 includes a case and a leading end portion that penetrates and is supported by the case such that it is slidingly displaceable via an elastic member so as to protrude to the outside from the case, and it is possible to detect whether the cartridge 1 is inserted in accordance with a displacement amount when the leading end portion is pressed. For example, the leading end portion may be a button, a lever or the like, instead of the slider. The elastic member may be a compression coil spring, a leaf spring or the like, instead of the torsion coil spring. In a similar manner, the transmission member 200 need not necessarily have the structure exemplified in the embodiment. It is sufficient if a displaceable protruding portion is provided on a slidingly displaceable leading end portion side of the detection switch 250 via an elastic member, and the protruding portion protrudes toward the holder 159. For example, the displaceable protruding portion 230 may be attached to the leading end side of the slider 252 of the detection switch 250 via the compression spring 240, and a section of the protruding portion 230 may be penetratingly supported by the support portion 134. Further, an elastic member (for example, rubber) that is different from the compression spring 240 may be used.

The switch support plate 132 and the protruding portion support plate 131 need not necessarily be the common members for the plurality of the detection switches 250 and the transmission members 200. Further, the surface of the protruding portion support plate 131 that faces the switch support plate 132 need not necessarily be larger than the switch support plate 132. Each of the detection switches 250 and the transmission members 200 need not necessarily be located diagonally above the position in which the plug 72 of the cartridge 1 is arranged or the position of the connection portion 180. Hereinafter, modified examples of the arrangement of the detection switches 250 and the transmission members 200 will be explained with reference to FIG. 20 to FIG. 23.

Figure 20:
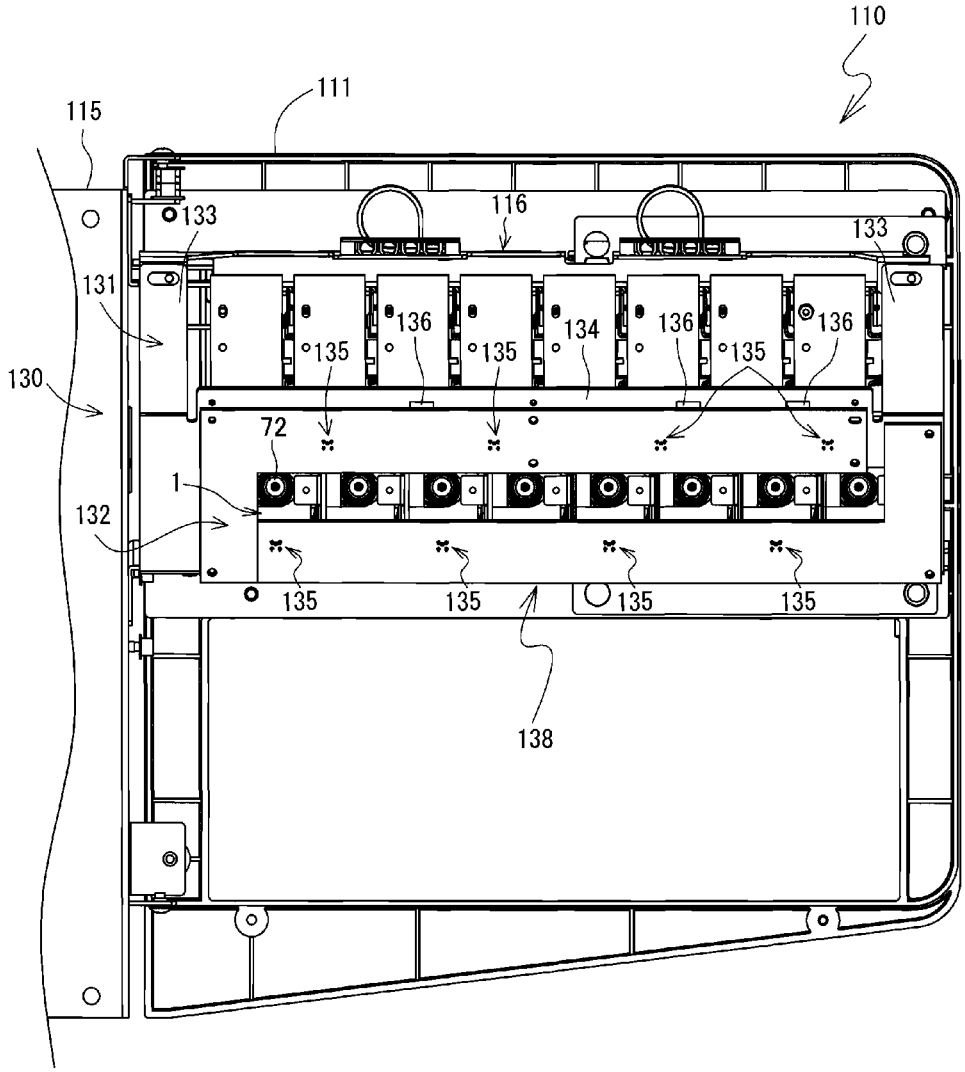
FIG. 20 is a rear view of the cartridge mounting unit 110 according to a first modified example.

As shown in FIG. 20, in a first modified example, as a substrate that supports the detection switches 250 (refer to FIG. 21), in addition to the switch support plate 132 that extends in the left-right direction above the positions in which the plugs 72 of the cartridges 1 are arranged, a lower support plate 138 is provided that extends in the left-right direction below the positions in which the plugs 72 are arranged. In other words, the switch support plate 132 and the lower support plate 138 surround, like a frame, an area in which the eight plugs 72 are arranged. Although, in FIG. 20, the protruding portion support plate 131 is hidden by the lower support plate 138, the protruding portion support plate 131 is not H-shaped in the first modified example, and the support portion 134 is formed like a frame corresponding to the switch support plate 132 and the lower support plate 138. Note that, also in second and third modified examples that will be described later, the structure and the arrangement of the switch support plate 132, the lower support plate 138 and the protruding portion support plate 131 are the same as those of the first modified example.

Corresponding to four of the eight cartridges 1, namely, the first, third, fifth and seventh cartridges 1 from the right, four of the attachment portions 135 are provided on the upwardly located switch support plate 132, diagonally to the left above the arrangement positions of the plugs 72. Corresponding to the remaining four of the eight cartridges 1, namely, the second, fourth, sixth and eighth cartridges 1 from the right, four of the attachment portions 135 are provided on the downwardly located lower support plate 138, below the arrangement positions of the plugs 72. In other words, the eight attachment portions 135 are arranged alternately above and below the arrangement positions of the plugs 72. In summary, the eight attachment portions 135 are arranged in a zigzag manner. As described above, the positions of the eight attachment portions 135 correspond to the positions of the eight sets of the detection switch 250 and the transmission member 200. Therefore, the eight sets of the detection switch 250 and the transmission member 200 are arranged in the zigzag manner above and below the arrangement positions of the eight plugs 72.

Figure 21:
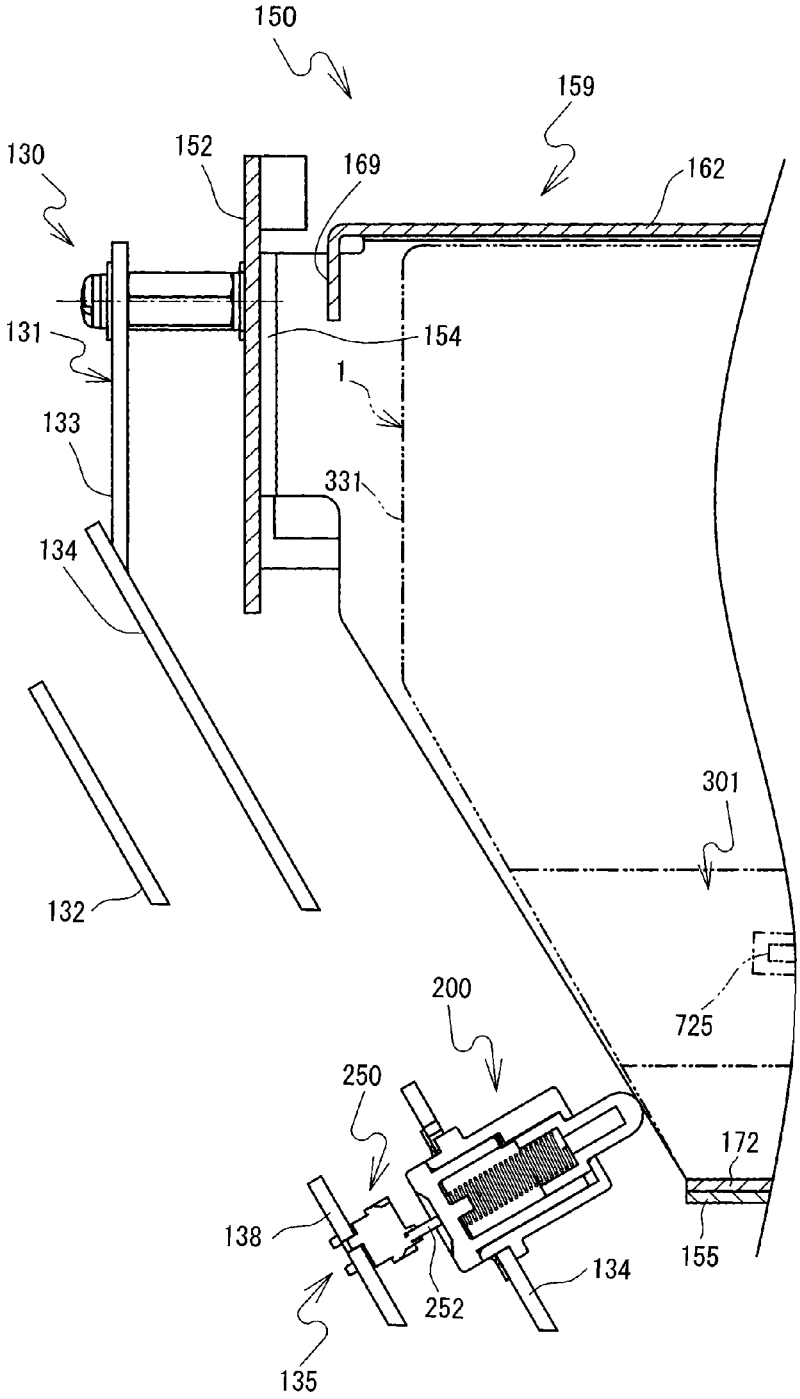
FIG. 21 is an explanatory view showing an arrangement of the detection switch 250 and the transmission member 200 according to the first modified example.

As shown in FIG. 21, the detection switch 250 and the transmission member 200 (for example, one set corresponding to the attachment portion 135 positioned on the leftmost side in FIG. 20) that are arranged below the arrangement position of the plug 72 are arranged in a position diagonally below the leg portion 301 when the cartridge 1 is inserted in the corresponding holder 159. Then, the transmission member 200 comes into contact with the inclined surface portion 332 and is pressed. Operations of the detection switch 250 and the transmission member 200 when the cartridge 1 is inserted in the holder 159 are the same as the above-described operations of the detection switch 250 and the transmission member 200 that are located above the arrangement position of the plug 72.

Depending on the size of the detection switch 250 and the transmission member 200, there are cases in which it is difficult to dispose all the plurality of sets of the detection switch 250 and the transmission member 200 respectively on the switch support plate 132 and the support portion 134 that are located above the arrangement positions of the plugs 72, as in the arrangement of the embodiment shown in FIG. 8. In particular, since the switch support plate 132 is a substrate on which wiring etc. is performed, a space for wiring is also necessary. Therefore, as in the first modified example, when the plurality of sets of the detection switch 250 and the transmission member 200 are arranged in the zigzag manner alternately above and below the arrangement positions of the plugs 72, there are advantages that the arrangement space of the detection switches 250 and the transmission members 200 and the wiring space can be easily secured. Note that, in the example shown in FIG. 20, the attachment portions 135 may be arranged first below and then above the arrangement positions of the plugs 72, in order from the right.

Figure 22:
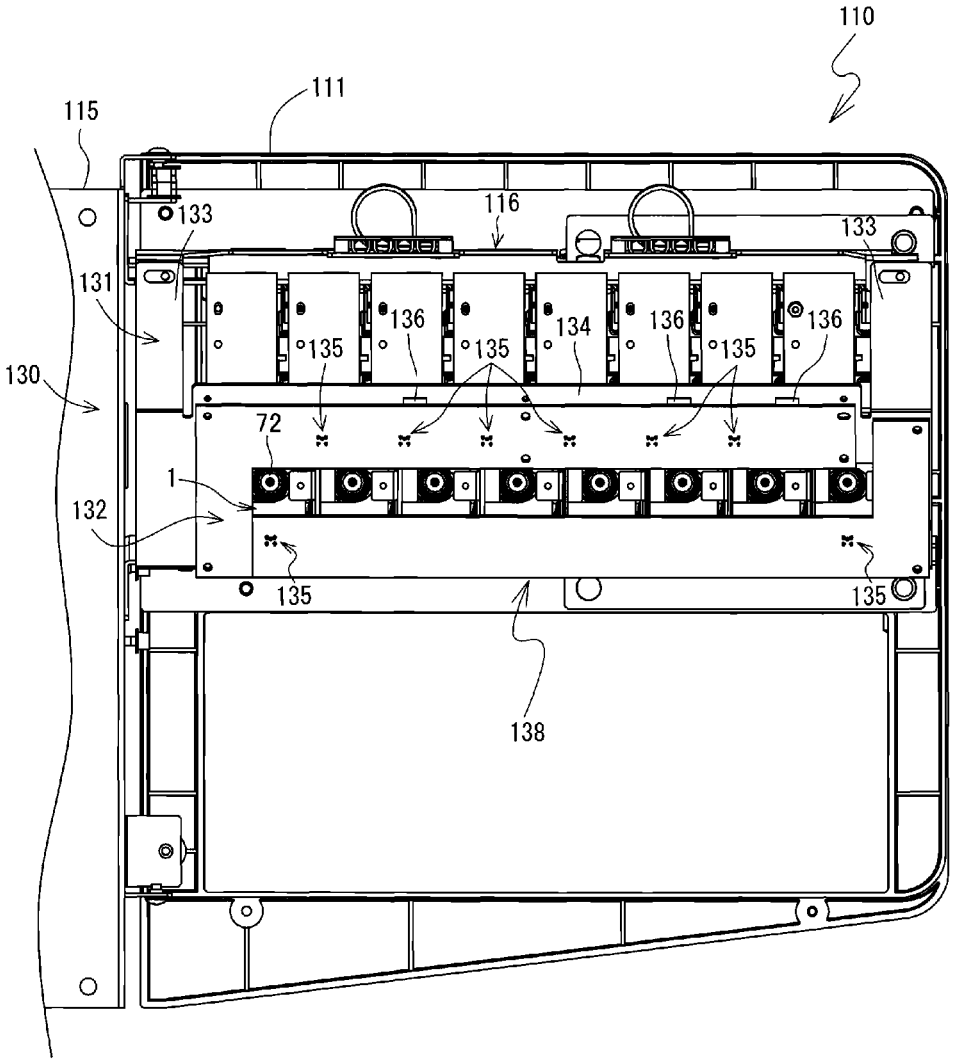
FIG. 22 is a rear view of the cartridge mounting unit 110 according to a second modified example.

As shown in FIG. 22, in the second modified example, some of the eight attachment portions 135 are provided on the switch support plate 132 and the remaining attachment portions 135 are provided on the lower support plate 138. More specifically, the eight sets of the detection switch 250 and the transmission member 200 are arranged such that some of the eight sets are arranged above the arrangement positions of the plugs 72, and the remaining sets are arranged below the arrangement positions of the plugs 72. In the example shown in FIG. 22, six sets, namely, the second to seventh sets are arranged on the upper left side of the arrangement positions of the plugs 72, and one set located on the rightmost side and one set located on the leftmost side are arranged below the arrangement positions of the plugs 72.

Screw holes to fix the switch support plate 132 to the protruding portion support plate 131 are provided on the right edge and the left edge of the switch support plate 132. With this structure, there is a possibility that the strength of the switch support plate 132 deteriorates when the attachment portion 135 is provided in the vicinity of the screw holes. In addition, there is a possibility that the space to arrange the detection switches 250 cannot be sufficiently secured. To address these possibilities, as shown by the example in FIG. 22, among the plurality of sets of the detection switch 250 and the transmission member 200, two sets corresponding to the right edge and the left edge of the switch support plate 132 are arranged on a side opposite to the side on which the other sets are arranged. Thus, it is possible to secure the strength of the switch support plate 132 and the lower support plate 138. Note that, among the plurality of sets of the detection switch 250 and the transmission member 200, some of the sets arranged above the arrangement positions of the plugs 72 and some of the sets arranged below the arrangement positions of the plugs 72 are not limited to the example shown in FIG. 22. The arrangement may be changed as appropriate depending on the arrangement space of the detection switches 250 and the transmission members 200 and the structure of the support members that support the detection switches 250 and the transmission members 200. In this way, it is possible to secure the strength of the support members and to enhance the freedom of arrangement of the detection switches 250 and the transmission members 200.

Figure 23:
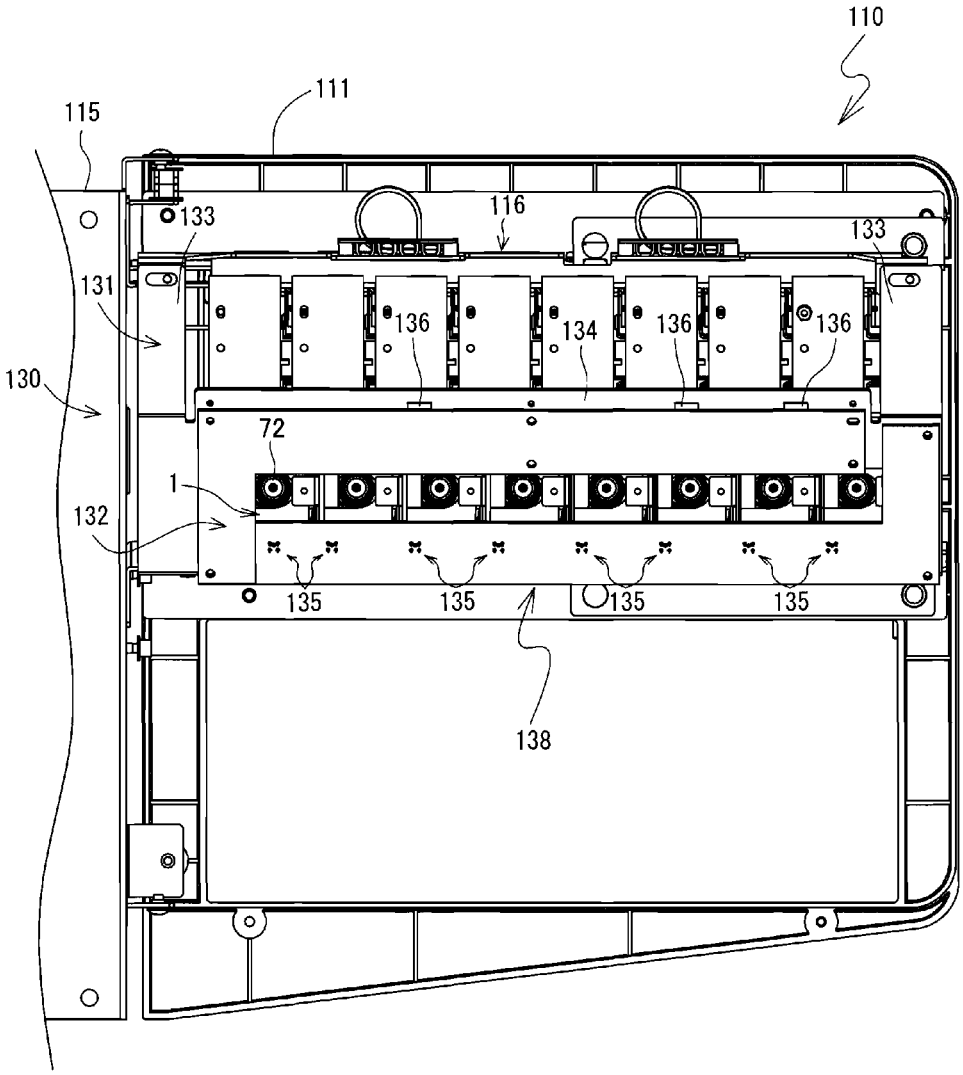
FIG. 23 is a rear view of the cartridge mounting unit 110 according to a third modified example.

Further, as in the third modified example shown in FIG. 23, all the eight attachment portions 135 may be provided on the lower support plate 138 and all the eight sets of the detection switch 250 and the transmission member 200 may be arranged below the arrangement positions of the plugs 72. Note that, in this case, as shown by the first to seventh attachment portions 135 from the right, it is preferable if seven sets of the detection switch 250 and the transmission member 200 are arranged in positions that are not directly below the arrangement positions of the plugs 72, as it is then possible to inhibit adhering of the ink that has leaked from the plugs 72.

The cartridge mounting unit 110 need not necessarily be formed as a general-purpose unit that can be inserted into and removed from a plurality of types of inkjet printers. The cartridge mounting unit 110 may be provided integrally with the printer 100. The structural component that guides each of the ink cartridges 1 to the lead-out needle 183 along the insertion/removal direction is not limited to the holder unit 150 that is provided with the holders 159. For example, it is sufficient if passages through which each of the cartridges 1 can be guided in the insertion/removal direction are provided in the housing 111. In addition, the number of the cartridges 1 that can be inserted is not limited to eight. In other words, the number of the holders 159 that are provided in the holder unit 150 may be any other number.

What is claimed is:

1. An inkjet printer that performs printing using ink supplied from an ink cartridge, the inkjet printer comprising:

a cartridge mounting portion into which and from which the ink cartridge can be inserted and removed; and a detection portion that is arranged in the cartridge mounting portion and that includes a detection switch which has a housing and a leading end portion and which detects whether the ink cartridge is inserted in the cartridge mounting portion in accordance with a displacement amount of the leading end portion when the leading end portion is pressed, the leading end portion being penetratingly supported by the housing via a first elastic member so as to be slidingly displaceable such that the leading end portion protrudes to the outside from the housing, and a protruding portion which is provided on the leading end portion side of the detection switch via a second elastic member so as to be displaceable and which protrudes toward the cartridge mounting portion, the second elastic member having an elastic modulus that is smaller than an elastic modulus of the first elastic member and causing the first elastic member to be deformed when the second elastic member is deformed by at least a predetermined amount, a displacement amount of the protruding portion when the second elastic member is deformed by at least the predetermined amount is greater than the displacement amount of the leading end portion.

2. The inkjet printer according to claim 1, wherein the detection portion further includes a first support plate which is a substrate that supports the detection switch; and a second support plate which is a plate member arranged to face the first support plate and which penetratingly supports the protruding portion such that the protruding portion is slidingly displaceable and such that the protruding portion protrudes toward the cartridge mounting portion that is located on an opposite side of the first support plate, the second support plate having a surface facing the first support plate that is larger than the first support plate.

3. The inkjet printer according to claim 1, wherein the protruding portion is supported by a cylindrically shaped support member, a cylindrically shaped sliding member is arranged on an inner side of the cylindrically shaped support member such that the cylindrically shaped sliding member is capable of sliding along an axial direction of the cylindrically shaped support member and is also capable of protruding from one end portion of the cylindrically shaped support member, the protruding portion is arranged on an inner side of the cylindrically shaped sliding member such that the protruding portion is capable of sliding along the axial direction and is also capable of protruding from the other end portion of the cylindrically shaped support member, and the second elastic member is interposed between the cylindrically shaped sliding member and the protruding portion, and urges the protruding portion in a direction of protruding from the protruding portion, with an urging force that is larger than a component in the axial direction of a weight of the protruding portion itself and that is smaller than a force that deforms the first elastic member.

4. The inkjet printer according to claim 1, wherein the cartridge mounting portion is provided as a plurality of cartridge mounting portions, the detection portion includes a plurality of the detection switches and a plurality of the protruding portions corresponding to the plurality of cartridge mounting portions, and the first support plate and the second support plate are provided, as a common plate member, corresponding to the plurality of detection switches and the plurality of protruding portions, respectively.

5. The inkjet printer according to claim 1, wherein the detection switch and the protruding portion are provided above an arrangement position of a plug when the ink cartridge is inserted in the cartridge mounting portion, the plug being used to draw out ink from an ink bag that is accommodated in a case of the ink cartridge.

6. The inkjet printer according to claim 5, wherein.

the detection switch and the protruding portion are provided in a position that is above, but not directly above, the arrangement position of the plug when the ink cartridge is inserted in the cartridge mounting portion.

7. The inkjet printer according to claim 1, wherein the cartridge mounting portion is provided as a plurality of cartridge mounting portions, the detection portion includes a plurality of sets of the detection switch and the protruding portion corresponding to the plurality of cartridge mounting portions, and the plurality of sets of the detection switch and the protruding portion are arranged alternately above and below arrangement positions of plugs when the ink cartridges are inserted in the cartridge mounting portions, each of the plugs being used to draw out ink from an ink bag that is accommodated in a case of the ink cartridge.

8. The inkjet printer according to claim 1, wherein the cartridge mounting portion is provided as a plurality of cartridge mounting portions, the detection portion includes a plurality of sets of the detection switch and the protruding portion corresponding to the plurality of cartridge mounting portions, and the plurality of sets of the detection switch and the protruding portion are arranged such that some of the sets are arranged above and a remaining number of the sets are arranged below arrangement positions of plugs when the ink cartridges are inserted in the cartridge mounting portions, each of the plugs being used to draw out ink from an ink bag that is accommodated in a case of the ink cartridge.

* * * * *